US009578418B2

(12) United States Patent
Le Nerriec et al.

(10) Patent No.: US 9,578,418 B2
(45) Date of Patent: Feb. 21, 2017

(54) SYSTEM AND METHOD FOR CONTROLLING OUTPUT OF MULTIPLE AUDIO OUTPUT DEVICES

(71) Applicant: QUALCOMM Incorporated, San Diego, CA (US)

(72) Inventors: Johan Le Nerriec, San Francisco, CA (US); Judah John Menter, Austin, TX (US); Daniel Tai, Union City, CA (US); Matthew Daniel Smith, San Jose, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/601,585

(22) Filed: Jan. 21, 2015

(65) Prior Publication Data

US 2016/0212535 A1 Jul. 21, 2016

(51) Int. Cl.

| | |
|---|---|
| ***H04R 3/12*** | (2006.01) |
| ***H04R 27/00*** | (2006.01) |
| *H04S 7/00* | (2006.01) |

(52) U.S. Cl.

CPC ..... *H04R 3/12* (2013.01); *H04R 27/00* (2013.01); *H04R 2227/003* (2013.01); *H04R 2227/005* (2013.01); *H04R 2420/07* (2013.01); *H04R 2430/01* (2013.01); *H04S 7/303* (2013.01); *H04S 2400/13* (2013.01)

(58) Field of Classification Search

CPC ..... H04R 3/12; H04R 2420/07

USPC ..... 310/313 D; 381/2, 57, 58, 81, 82, 107, 381/300, 335, 17, 71.11, 74, 103, 174, 381/734, 86, 307; 700/94; 704/246, 236, 704/500, 501, 270; 367/83, 95; 379/406.01; 84/600, 615, 622; 348/734; 705/17

See application file for complete search history.

(56) References Cited

U.S. PATENT DOCUMENTS

| | | | | |
|---|---|---|---|---|
| 5,285,521 | A * | 2/1994 | Holt | G01N 29/0609 704/270 |
| 5,426,339 | A * | 6/1995 | Wright | H03H 9/643 310/313 B |
| 5,675,708 | A * | 10/1997 | Fitzpatrick | G06F 17/30569 704/200 |
| 5,729,694 | A * | 3/1998 | Holzrichter | G10L 15/24 704/270 |
| 6,404,886 | B1 * | 6/2002 | Yoshida | H04M 9/082 379/406.01 |
| 6,505,154 | B1 * | 1/2003 | Bottenbruch | G10L 15/02 704/207 |

(Continued)

FOREIGN PATENT DOCUMENTS

| | | |
|---|---|---|
| EP | 2393313 A2 | 12/2011 |
| EP | 2753095 A2 | 7/2014 |

(Continued)

OTHER PUBLICATIONS

WISA: "Easy Setup and Optimization," Retrieved on Aug. 4, 2014, pp. 2, Retrieved from URL: http://www.wisaassociation.org/Compliance/System-Set-up.aspx.

(Continued)

*Primary Examiner* — Gerald Gauthier
(74) *Attorney, Agent, or Firm* — Paradice and Li LLP

(57) ABSTRACT

Multiple audio output devices are individually triggered to generate an acoustic identification signal. A controller device can perform a comparison of the acoustic identification signal from each of the multiple audio output devices. The output from one or multiple audio output devices is controlled based on the comparison.

20 Claims, 8 Drawing Sheets

(56) References Cited

U.S. PATENT DOCUMENTS 6,614,912 B1 9/2003 Yamada et al.
7,135,635 B2 * 11/2006 Childs ..... G10H 1/0025 700/94
7,138,575 B2 * 11/2006 Childs, Jr. ..... G06Q 40/00 700/94
7,283,635 B1 * 10/2007 Anderson ..... H04M 1/60 381/384
7,415,124 B2 * 8/2008 Colich ..... H04R 1/403 181/199
7,561,698 B1 * 7/2009 Pomerantz ..... H04R 5/02 381/123
8,208,645 B2 * 6/2012 Ingalls ..... H04M 3/56 381/58
8,247,677 B2 * 8/2012 Ludwig ..... G10H 1/06 84/622
8,311,226 B2 11/2012 Lorgeoux et al.
8,320,824 B2 11/2012 Banks et al.
8,724,600 B2 5/2014 Ramsay et al.
8,737,638 B2 * 5/2014 Sakurada ..... G10H 1/0058 381/119
9,167,339 B2 * 10/2015 Knox ..... H04R 1/10
9,294,860 B1 * 3/2016 Carlson ..... H04R 29/008
9,319,794 B2 * 4/2016 Betlehem ..... H04R 5/02
9,324,322 B1 * 4/2016 Torok ..... G10L 15/22
2003/0026169 A1 * 2/2003 Schultz ..... E21B 47/16 367/83
2003/0220705 A1 * 11/2003 Ibey ..... H04R 5/04 700/94
2007/0160225 A1 7/2007 Seydoux
2007/0189549 A1 * 8/2007 Scheel ..... H04R 27/00 381/86
2008/0114605 A1 * 5/2008 Wu ..... G11B 20/00007 704/500
2010/0014685 A1 * 1/2010 Wurm ..... G10K 11/178 381/71.11
2010/0260348 A1 10/2010 Bhow et al.
2011/0164188 A1 * 7/2011 Karaoguz ..... G06F 3/011 348/734
2013/0117032 A1 * 5/2013 Ip ..... G10L 19/173 704/501
2013/0170647 A1 7/2013 Reilly et al.
2013/0223658 A1 * 8/2013 Betlehem ..... H04S 3/002 381/307
2013/0243199 A1 * 9/2013 Kallai ..... G11B 19/02 381/17
2014/0146970 A1 5/2014 Kim et al.
2014/0233759 A1 * 8/2014 McCollough ..... H03G 3/32 381/107
2014/0270187 A1 9/2014 Hall et al.
2014/0270282 A1 * 9/2014 Tammi ..... H04R 5/02 381/300
2014/0277653 A1 * 9/2014 Watts ..... G06F 3/165 700/94
2014/0316543 A1 * 10/2014 Sharma ..... H04L 67/10 700/94
2015/0131820 A1 * 5/2015 Veneri ..... H04R 23/00 381/174
2015/0279374 A1 * 10/2015 Roblek ..... G10L 17/24 704/246
2015/0289038 A1 * 10/2015 Zartarian ..... H04R 3/04 381/103
2015/0381296 A1 * 12/2015 Jenq ..... H04S 1/007 381/2
2015/0382128 A1 * 12/2015 Ridihalgh ..... H04S 7/301 381/57
2016/0044394 A1 * 2/2016 Derom ..... H04R 1/00 367/95
2016/0212534 A1 * 7/2016 Le Nerriec ..... H04R 3/12
2016/0212535 A1 * 7/2016 Le Nerriec ..... H04R 3/12

FOREIGN PATENT DOCUMENTS

WO WO-2007028094 A1 3/2007
WO WO-2013022483 A1 2/2013

OTHER PUBLICATIONS

International Search Report and Written Opinion—PCT/US2016/012430—ISA/EPO—Mar. 18, 2016.

* cited by examiner

SYSTEM AND METHOD FOR CONTROLLING OUTPUT OF MULTIPLE AUDIO OUTPUT DEVICES

BACKGROUND

Audio systems exist that utilize network connected audio output devices (e.g., speakers). In such systems, multiple connected speakers can be used to output the same content.

DETAILED DESCRIPTION

Figure 1:
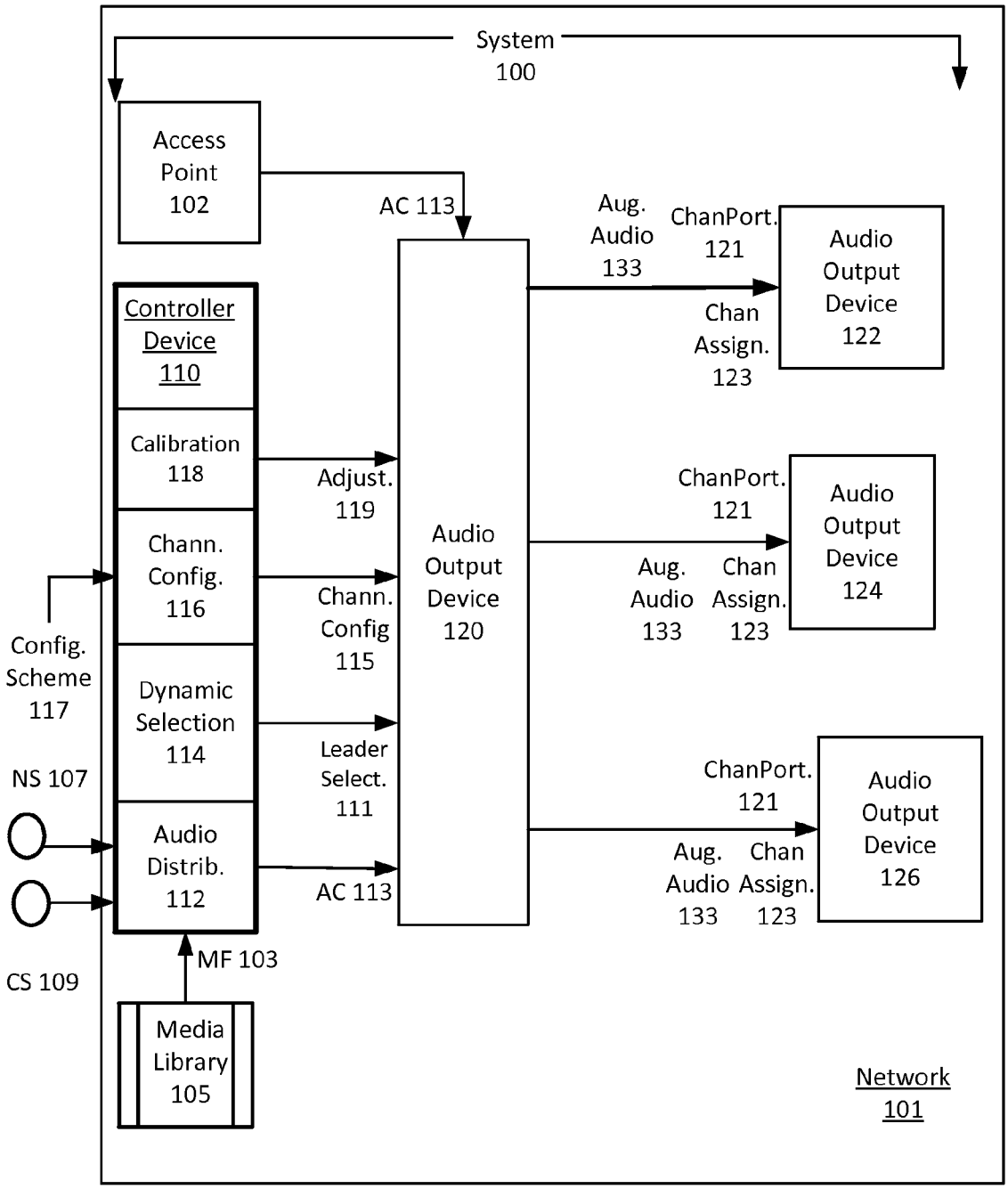
FIG. 1 illustrates a network-based audio output system that is capable of dynamic configuration and/or calibration, according to various embodiments.

According to some embodiments, a set of audio output devices can be established and configured to output channel specific audio. Once established, the channel configuration can be changed and updated in response to events such as changes to user preference, or the addition or subtraction of audio output devices to the network. In some embodiments, the reconfiguration can be performed on the fly while audio content is being outputted by the devices.

In some embodiments, the audio output devices can be controlled so that the output of the device is calibrated to the position of the user. In particular, the arrival time and/or volume of the audio can be calibrated so that the user experiences the output from perspective of being equally separated from each audio output device, with each audio output device providing a uniform audio output.

Embodiments described herein provide for a system, method, and device for outputting audio content over a network. In some embodiments, multiple audio output devices that are connected on a network to form an audio output set for receiving and outputting at least a portion of an audio content originating from a source. A controller device can determine a channel configuration for the audio output set. The channel configuration can include a channel assignment for each audio output device that is connected on the network to form the audio output set. When the audio content is being outputted, the controller device can respond to an event or condition by changing the channel configuration.

In some embodiments, a controller device determines a channel configuration for the audio output set. The channel configuration may include a channel assignment for each audio output device that is connected on the network to form the audio output set. The controller device receives audio content from a source, and outputs a channel portion of the audio content based on a channel assignment of the given audio output device. For each of the other audio output devices, the controller device communicates at least another portion of the audio content to the other audio output device. Additionally, the controller responds to an event or condition by changing the channel configuration and then outputting the channel portion of the audio content based on the new channel assignments.

In some embodiments, each of multiple audio output devices are triggered to generate an acoustic identification signal. A controller device can perform a comparison of the acoustic identification signal from each of the multiple audio output devices. The output from one or multiple audio output devices is controlled based on the comparison.

As used herein, a speaker is intended to mean an audio output device, such as a network-connected audio output device. One example of a speaker includes a dedicated device that outputs audio such as music. Another non-limiting example of a speaker includes a multifunctional device, such as a mobile device or tablet, which can output video, capture and store audio content, enable user interaction and/or perform numerous other actions.

Various embodiments described herein provide that methods, techniques, and actions performed by a computing device are performed programmatically, or as a computer-implemented method. Programmatically means through the use of code, or computer-executable instructions. A programmatically performed step may or may not be automatic.

Various embodiments described herein may be implemented using programmatic modules or components. A programmatic module or component may include a program, a subroutine, a portion of a program, or software or a hardware component capable of performing one or more stated tasks or functions. As used herein, a module or component can exist on a hardware component independently of other modules or components. Alternatively, a module or component can be a shared element or process of other modules, programs, or machines.

Furthermore, various embodiments described herein may be implemented through instructions that are executable by one or more processors. These instructions may be carried on a computer-readable medium. Machines shown or described with figures below provide examples of processing resources and computer-readable mediums on which instructions for implementing embodiments of the invention can be carried and/or executed. In particular, the numerous machines shown with embodiments of the invention include processor(s) and various forms of memory for holding data and instructions. Examples of computer-readable mediums include permanent memory storage devices, such as hard drives on personal computers or servers. Other examples of computer storage mediums include portable storage units, such as CD or DVD units, flash or solid state memory (such as carried on many cell phones and consumer electronic devices), and magnetic memory. Computers, terminals, network enabled devices (e.g., mobile devices such as cell phones) are all examples of machines and devices that utilize processors, memory, and instructions stored on computer-readable mediums. Additionally, embodiments may be implemented in the form of computer-programs, or a computer usable carrier medium capable of carrying such a program.

System Description

FIG. 1 illustrates a network-based audio output system 100 that is capable of dynamic configuration and/or calibration, according to various embodiments. The audio output system 100 can be implemented in a local or closed network 101, such as provided by a home or local area network. The network 101 can include multiple connected devices, including a controller device 110 and multiple network enabled audio output devices 120, 122, 124, and 126. In some variations, the network 101 includes an access point 102 for providing a wireless connectivity medium. By way of example, each of the controller device 110 and the audio output devices 120, 122, 124, 126 can operate under IEEE Specifications of 802.11(a), 802.11(b), 802.11(g), 802.11(n), 802.11(ac), or the like (collectively "Wi-Fi," "Wi-Fi network," or "802.11 protocol"). Still further, in some implementations, the controller device 110 and/or some or all of the audio output devices 120, 122, 124, 126 are capable of wireless peer-to-peer communications, such as provided by Wi-Fi Direct. Still further, some or all of the audio output devices 120, 122, 124, and 126 may be able to communicate directly with other devices on the network as peers. By way of example, the individual audio output devices 120, 122, 124, and 126 can communicate using a direct, wireless peer-to-peer communication protocol, such as provided by Wi-Fi Direct. Still further, in some variations, one or more of the audio output devices 120, 122, 124, and 126 can utilize a connectivity medium such as provided through an Ethernet connection or other network-based wired connection.

The audio output devices 120, 122, 124, and 126 can be connected and positioned in a physical region of the network 101, based on preference of a user. A physical region of the network 101 can correspond to a dwelling, or alternatively, to a room or space within the dwelling. By way of example, an environment of the network 101 can correspond to a home network in which multiple speakers or other audio output devices are provided with network connectivity for purpose of outputting audio content selected by the user. In this context, the user may selectively position individual connected speakers about a room to enhance the user's enjoyment of rendered audio content.

In some embodiments, the audio output devices 120, 122, 124, and 126 can be heterogeneous in nature, meaning that the audio output devices 120, 122, 124, and 126 can have different manufacturers, capabilities, resources and/or purposes. For example, one or more of the audio output devices 120, 122, 124, and 126 can correspond to a television, for which audio output is not a primary purpose. One or more of the audio output devices 120, 122, 124, and 126 can also include programming or other logic to enable that audio output device to communicate with other devices on the network. An example of such programming or logic includes ALLPLAY platform, manufactured by QUALCOMM CONNECTED EXPERIENCES, which can be installed or otherwise provided through firmware on wireless speakers. While some examples describe audio output devices 120, 122, 124, and 126 as speakers (or dedicated audio output devices), other variations provide for audio output devices 120, 122, 124, and 126 which have mufti-purposes, including televisions, desktop computers, or other multifunction audio output devices.

The controller device 110 operates to execute an application, software platform, or other programming logic in order to communicate with and control the audio output devices 120, 122, 124, and 126. By way of example, the controller device 110 can correspond to a mobile computing device, such as a multifunction cellular telephony/messaging device, tablet, hybrid device (so called "phablet"), or wearable computing device.

The controller device 110 can operate to control and configure the output of audio using the audio output devices 120, 122, 124, and 126. Any one of multiple audio distribution configurations can be used for purpose of outputting the audio content on multiple audio output devices 120, 122, 124, and 126 in accordance with a dynamically selected channel configuration. In some embodiments, the controller device 110 can be operated modally in order to select from multiple possible audio distribution configurations.

The controller device 110 distributes audio content ("AC") 113 directly or indirectly to each of the multiple audio output devices 120, 122, 124, or 126. In some implementations, the controller device 110 is the source of the audio content 113 being distributed. For example, the audio content 113 can correspond to media files ("MF") 103 that are accessed from a media library 105 of the user. Depending on implementation, the media library 105 can be local to the controller device 110, distributed amongst multiple devices on the network 101, or remote to the controller device 110. For example, some or all of the media library 105 can be stored on other devices (including one or more of the audio output devices 120, 122, 124, or 126) or resources of the network 101, and the controller device 110 can communicate with another device on the network 101 (e.g., home computer, cable box, etc.) in order to retrieve media files 103 from the media library 105. Still further, the controller device 110 can access network services ("NS") 107 for the audio content 113, such as online media sites (e.g., PANDORA, SPOTIFY, GOOGLE PLUS, etc.). The controller device 110 can also generate audio content 113 from other content sources ("CS") 109, such as cable, satellite or over-the-air broadcasts. Additionally, the controller device 110 can distribute the audio content 113 originating from multimedia content that is rendered on the device. For example, the controller device 110 can execute different applications which generate multimedia content (e.g., games), and audio from these active applications can be distributed as the audio content 113. In other variations, the controller device 110 can access another device or resource on the network 101, such as a device that communicates with one or more of the audio output devices 120, 122, 124, or 126 through the wireless access point 102. Depending on the capabilities of the respective devices, the controller device 110 can use peer-to-peer wireless communications (e.g., Wi-Fi Direct) in order directly transmit the audio content 113 to each of the desired audio output devices 120, 122, 124, and 126 on the network 101.

In some implementations, the controller device 110 distributes the audio content 113 through one of the audio output devices 120, 122, 124, 126 that implement functionality for operating as the leader of the active output devices on the network 101. The controller device 110 may select one of the audio output devices 120, 122, 124, 126 to serve as the leader device. In an example of FIG. 1, the audio output device 120 that is selected as the leader can receive the audio content 113 from the controller device 110 (which can access the media library 105, network service 107 or content source 109) for distribution to the other audio output devices 122, 124, 126. In variations, the audio output device 120 can receive the audio content 113 from another source (e.g., another device of network 101), under direction or control of the controller device 110, for distribution to the other audio output devices 122, 124, 126.

In alternative variations or modes, either the controller device 110 or the audio output device 120 that operates as the leader can channel filter or augment the audio content 113 for transmission to the respective audio output devices. When channel filtered, the audio content 113 can be delineated into multiple channel portions 121, and each channel portion 121 of the audio content 113 is communicated to an assigned audio output device 120, 122, 124, and 126. When augmented, the audio content 113 can be pre-structured into channeled components, and the augmented audio ("aug. audio") 133 can be transmitted to the other audio output devices 122, 124, 126 where the augmented audio 133 is filtered into a corresponding channel portion 121.

Figure 2:
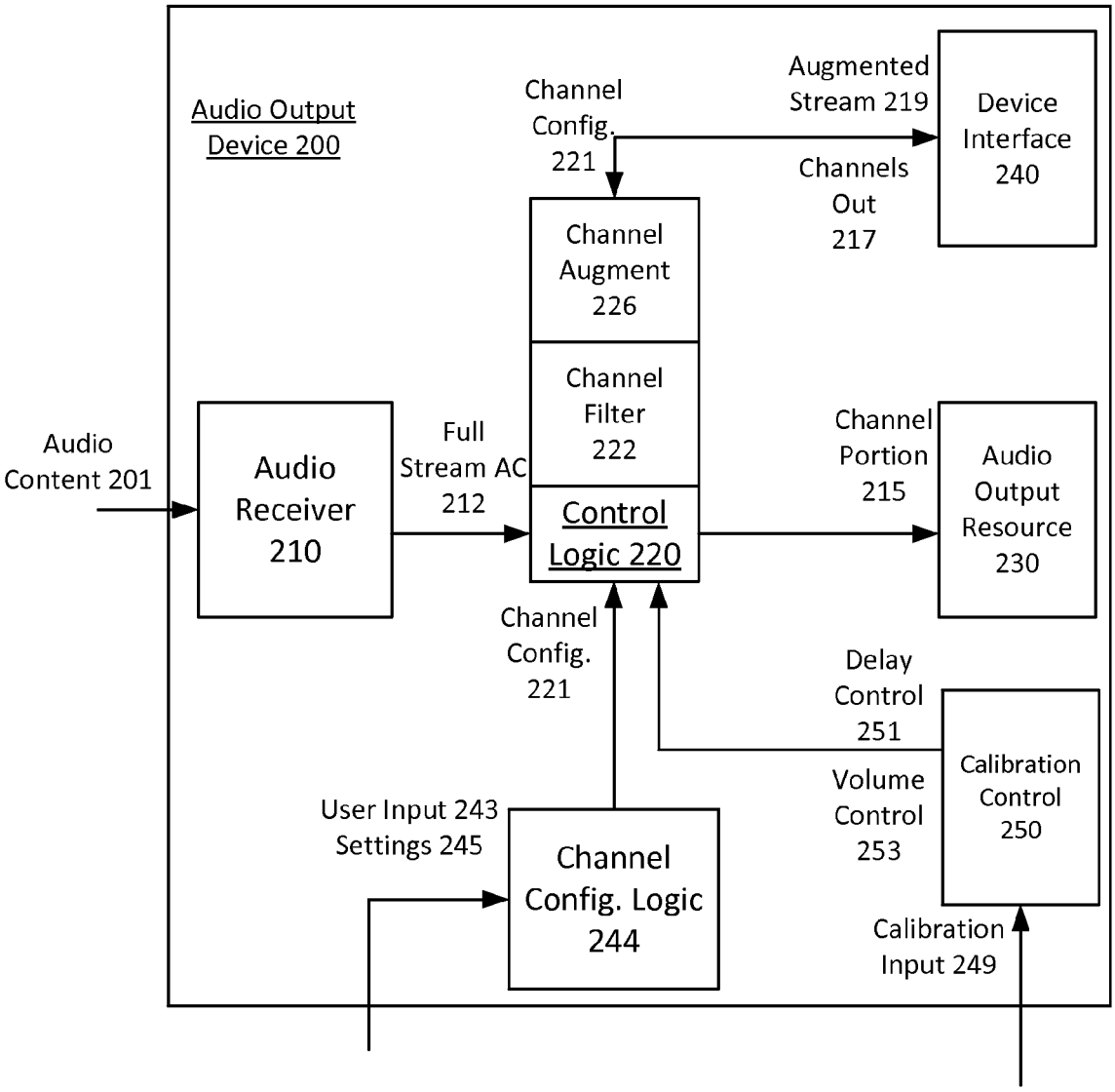
FIG. 2 illustrates an audio output device that is capable of being selected and operated as a leader device according to various embodiments.

In an example of FIG. 1, the controller device 110 includes an audio distribution logic 112, a dynamic selection logic 114, a channel configuration logic 116, and a calibration logic 118. Furthermore, in an example of FIG. 1, one or more of the audio output devices 120, 122, 124, and 126 can be selected to implement the functionality of the leader, which can include components and functionality (e.g., as described with an example of FIG. 2). The functionality shown to be described with either the controller device 110 or the audio output device 120 that is selected as the leader can be interchangeable amongst the two devices (or amongst another device that can be substituted as the leader for the audio output device 120). For example, in some variations, the controller device 110 can include functionality for implementing channel filtering or channel augmentation (e.g., as shown in FIG. 2). Likewise, in some variations, the audio output device 120 can operate as the leader and also include one or more of the components of the controller device 110, such as one or more of the dynamic selection logic 114, channel configuration logic 116, or calibration logic 118.

According to some embodiments, the controller device 110 includes the channel configuration logic 116 for performing operations to determine a channel configuration 115 of the set of audio output devices 120, 122, 124, and 126. The channel configuration 115 can be determined by (i) a number of available audio output devices 120, 122, 124, and 126, (ii) a configuration scheme 117 or layout that is based on preference and/or the number of available audio output devices 120, 122, 124, and 126, and/or (iii) the relative positioning of each audio output device 120, 122, 124, and 126 within the space or environment of the network 101. Accordingly, the channel configuration 115 can specify channel assignments 123 for each audio output device 120, 122, 124, and 126, given a desired or available configuration scheme 117 and the relative positioning of the audio output devices. Once determined, channel assignments 123 can be communicated to the audio output devices 122, 124, 126 as control or command data. Depending on implementation or mode of operation, the channel assignments 123 can be communicated directly from the controller device 110 or from the audio output device 120 that is acting as the leader. As described with various examples, the channel configuration logic 116 can dynamically re-determine and implement the channel configuration 115 based on the occurrence of conditions and events that affect usage of the audio output devices 120, 122, 124, and 126 on the network 101.

Still further, in some variations, the controller device 110 can have different modes of operation in order to implement an audio distribution configuration in which the audio distribution logic 112 directly distributes the audio content 113 to each of the audio output devices 120, 122, 124, and 126. The audio distribution logic 112 of the controller device 110 can communicate either a full or partial stream to multiple audio output devices.

According to variations, in an alternative mode, the controller device 110 can use the dynamic selection logic 114 to select one of the multiple audio output devices 120, 122, 124, 126 as a leader. In some variations, the determination to use the particular audio output device 120 as the leader can be made programmatically, based on, for example, available resources of the controller device 110 and/or preferences of the user. Various criteria can be used to select one audio output device 120 as the leader for the other audio output devices 122, 124, or 126 of the network 101. Among the criteria, the audio output device 120, 122, 124, and 126 that is selected to be the leader may be required to have a minimum set of resources, such as a minimum processing capability and/or the ability to establish multiple simultaneous peer-to-peer connections with other devices on the network 101. Alternatively, the audio output device 120 that is selected as the leader can have the most or best of a desired resource or capability. For example, the audio output device 120 can be selected as the leader because the audio output device 120 satisfies a criterion of containing digital signal processor ("DSP"), or because the audio output 120 device is deemed to have the greatest amount of available bandwidth as compared to the other audio output devices.

In some variations, the control device 110 can communicate a leader selection 111 to the selected audio output device 120, 122, 124, or 126. In some embodiments, the controller device 110 makes the leader selection 111 programmatically using for example, the dynamic selection logic 114.

In some implementations, the audio output device 120 receives the audio content 113 from a content source (CS) 109, and then distributes the audio content 113 as the channel portions 121 to each of the other audio output devices 122, 124, 126 of the network 101. The source of the audio content 113 can, for example, correspond to controller device 110. For example, controller device 110 can generate the audio content 113 (e.g., gaming content) and/or store portions of the media library 105, such as a library of songs or albums, and the audio content 113 can correspond to a media file 103 from the media library 105. Alternatively, controller device 110 can also serve as a source for audio content retrieved from both local network and remote sources. For example, the controller device 110 can access other media resource devices (e.g., home computer, cable box, etc.) on the network 101 in order to retrieve the media files 103 of the user's media library. Still further, the controller device 110 can access commercially available third party network services 107 for the audio content 113 (e.g., PANDORA, SPOTIFY, GOOGLE PLUS, etc.). In other variations, the content source 109 for the audio content 113 can be another device on the network 101, such as a device that communicates with the controller device 110 and/or output device 120 through the wireless access point 102. Still further, in other variations, the source of the audio content 113 can be another content source 109 (e.g., cable or over-the-air broadcast) available through the network 101.

According to some variations, the audio output device 120 processes the audio content 113 (full audio data) to delineate the channel portions 121 from the full audio content 113. Each channel portion 121 can then be communicated to corresponding audio output device 122, 124, 126. The channel portion 121 for the audio output device 120 can be played using a local audio output resource, in concert with the playback of the channel portions 121 of the other audio output devices 122, 124, 126.

According to some embodiments, the channel configuration 115 can be dynamically determined on the fly, based on conditions or events detected on the network 101. For example, the controller device 110 can detect a particular network condition (e.g., limited bandwidth) and then output the channel configuration 115 to include an alternative set of channel assignments 123 for the respective audio output devices 120, 122, 124, and 126. Still further, the controller device 110 can receive input, or otherwise detect the addition or subtraction of an audio output device 122, 124, or 126, so as to affect a number of audio output devices 120, 122, 124, and 126 that are in use. In some cases, a change in the number of audio output devices 120, 122, 124, and 126 that are in use can also change the configuration scheme 117 (e.g., from 7.1 to 5.1) and/or require further changes to the channel assignment 123, in order to accommodate a different number of audio output devices 120, 122, 124, and 126 that are in use (or available for use) on the network 101. The ability of the controller device 110 to dynamically determine and implement channel configurations can enable, for example, playback of the audio content from some or all of the audio output devices 120, 122, 124, and 126 to continue substantially uninterrupted while one or more channel assignments 123 takes place. In addition to dynamically determining the channel configuration 115, the controller device 110 can dynamically select the audio output device 120 that is the leader. The determination of which audio output device 120 serves as the leader can be based on, for example, the available bandwidth for each of audio output device 120, 122, 124, or 126 that satisfy one or more criteria for being the leader.

As still another example, the modal operation of the controller device 110 in distributing the audio content 113 can also be dynamically changed. For example, the controller device 110 can switch from using one audio output device 120 as the leader to directly transmitting the audio content 113 (or channel portions 121 thereof) to each audio output device 120, 122, 124, and 126. Still further, the selection of which audio output device 120, 122, 124, 126 serves as the leader can also be dynamic, based on factors such as the available bandwidth to the respective audio output devices 120, 122, 124, 126.

In some variations, the controller device 110 includes the calibration logic 118. The calibration logic 118 can operate to adjust output of the audio output devices 120, 122, 124, 126 to accommodate a relative position of the user in the physical space of the environment of the network 101. The calibration logic 118 can operate to accommodate the proximity of the user to one or more of the audio output devices 120, 122, 124, and 126. The calibration logic 118 can implement operations so that the audio experienced by the user at a given location is uniform from all direction. In particular, the calibration logic 118 can implement adjustments 119 in the form of delays in individual audio output devices 120, 122, 124, and 126 so that the arrival time of audio transmissions from each of the respective audio output devices 120, 122, 124, 126 is near simultaneous with respect to the user, even though the user may be closer to one audio output device 120, 122, 124, 126 as compared to another. Still further, the calibration logic 118 can implement adjustments 119 in the form of volume adjustment for the individual audio output devices 120, 122, 124, 126 so that the volume experience by the user from each of the audio output devices 120, 122, 124, 126 is the same, even when the user is closer to one audio output device as compared to another.

FIG. 2 illustrates an audio output device that is capable of being selected and operated as a leader, according to various embodiments. An audio output device 200 such as shown and described with an example of FIG. 2 can operate as the audio output device 120 that is depicted as being the leader of an example of FIG. 1. With reference to FIGS. 1-2, in more detail, the audio output device 200 includes an audio receiver 210, control logic 220, a local audio output resource 230, and a device interface 240. The control logic 220 can be coupled with or include channel filter 222 and/or channel augmentation 226.

The audio receiver 210 can receive audio content 201 from the controller device 110. Alternatively, the audio receiver 210 can receive the audio content 201 from another source, such as from an online source or from another device. The audio content 201 can be received either directly or indirectly (e.g., via an access point 102 or from the controller device 110).

The audio output device 200 can also receive channel configuration data 221 from the controller device 110 (shown via the device interface 240). In variations, the audio output device 200 includes channel configuration logic 244 for determining channel configuration data 221 independently of any communication from another device. The channel configuration logic 244 can determine channel configuration data 221 from, for example, user input 243, such as provided through the user's interaction with a user interface of the audio output device 200. The channel configuration logic 244 can also determine channel configuration data 221 based on settings 245 or preferences of the user or device.

In some implementations or modes of operation, the audio receiver 210 can communicate the full stream of audio content ("full stream AC") 212 to the channel filter 222 of control logic 220. The channel filter 222 filters the full stream of audio content 212 into channeled portions based on channel assignments defined by the channel configuration data 221. Once channels are delineated from the audio content 212, audio output resource 230 receives the channel portion 215 for the channel assigned to the audio output device 200. The portion of the audio content 217 for the channels assigned to the other audio output devices 122, 124, 126 can be transmitted to the other audio output devices via the device interface 240.

In a variation, the audio output device 200 can implement channel augmentation 226. Channel augmentation 226 can structure the full stream 212 of the audio content into an augmented stream 219 that can be transmitted to the other audio output devices 122, 124, 126 via the device interface 240. The augmented stream 219 can be readily filtered for an appropriate channel at the corresponding audio output device 122, 124, 126, which coincides with the point of output for the particular channel output. The device interface 240 can communicate a full augmented stream 219, which can be readily filtered for a given channel. In this way, the channel augmentation 226 can provide an alternative to filtering the audio content in advance of transmission.

The device interface 240 can include programming or logic to enable audio output device 200 to be interconnected and operable with multiple other devices of different kinds on the network 101. In some implementations, the device interface 240 includes an application program interface provided through, for example, ALLPLAY, manufactured by QUALCOMM CONNECTED EXPERIENCES.

In some embodiments, the audio output device 200 includes functionality for triggering or implementing calibration control 250. In some implementations, the calibration control 250 receives calibration input 249 from another device, such as from controller device 110. In one example, controller device 110 includes resources and logic for receiving input that is indicative of calibration variations, and further includes resources and logic to determine calibration actions that can be taken on one or more of the audio output devices 120, 122, 124, 126 in order to calibrate the audio output for the location of the user. As mentioned with other examples, the calibration actions serve to affect an audio output experienced by the user, with specific consideration for a relative proximity of the user to individual audio output devices 120, 122, 124, 126 of the network 101.

In some embodiments, the calibration actions of the calibration control 250 can include delay control 251. The control logic 220 can process and communicate the delay control 251 to other audio output devices 122, 124, 126 via the device interface 240. Another example of calibration actions of calibration control 250 includes volume control 253. The control logic 220 can communicate the volume control 253 to the other audio output devices via the device interface 240.

Controller Device

Figure 3:
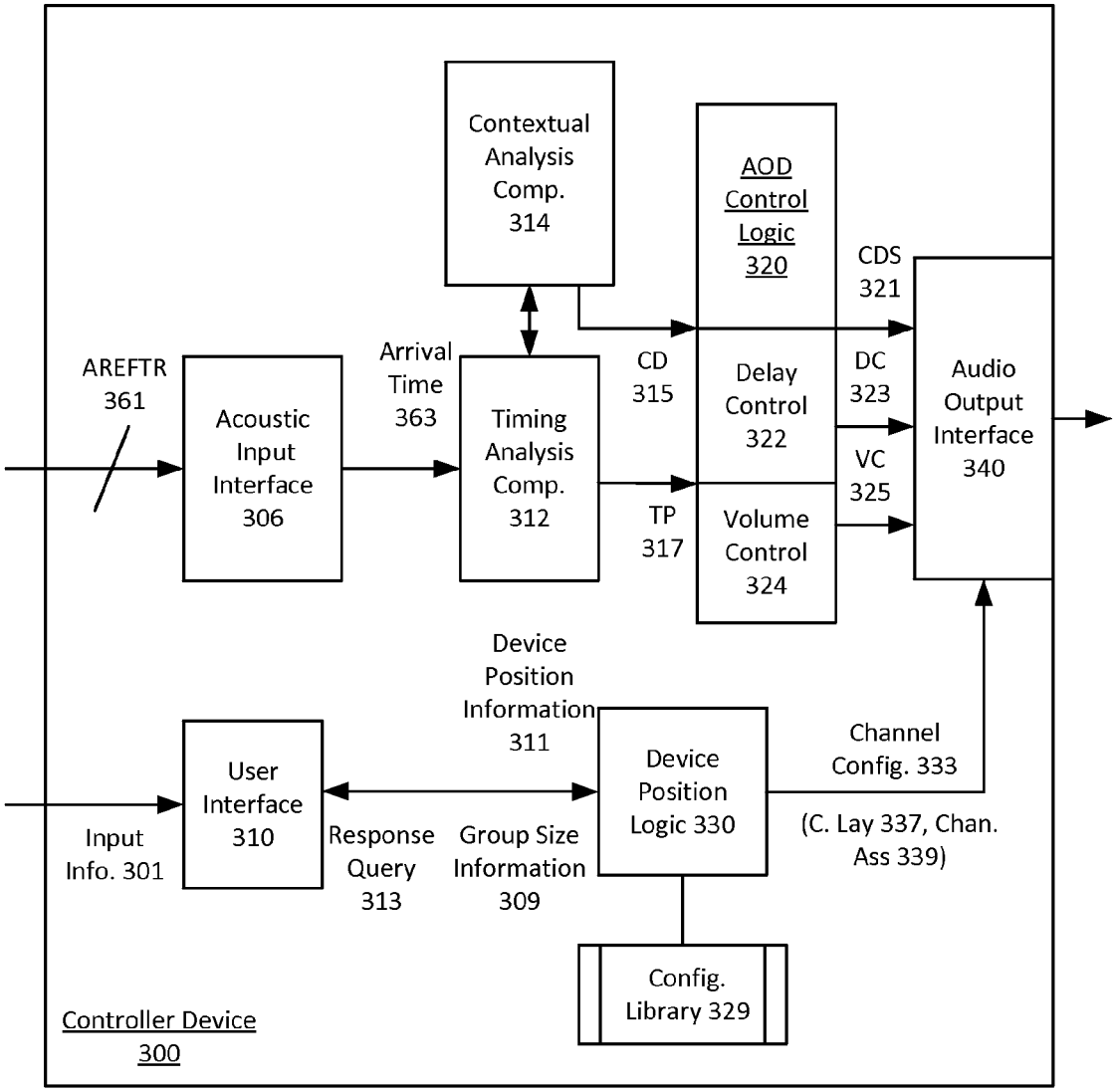
FIG. 3 illustrates an example of a controller device for use with various embodiments.

FIG. 3 illustrates an example of a controller device 300, according to various embodiments. With reference to FIGS. 1-3, according to various embodiments, the controller device 300 (which may correspond to the controller device 110) can be implemented using software that executes on a mobile computing device, such as a device that can be carried by a person within the space or physical region of the network 101. By way of example, the controller device 300 can correspond to a device such as a cellular telephony/messaging device (e.g., feature phone), tablet or hybrid device, wearable computing device, or laptop. In some embodiments, the controller device 300 operates to receive input information 301 for determining (i) a number of audio output devices 120, 122, 124, 126, 200 that are connected on the network 101, and (ii) the location of each audio output device 120, 122, 124, 126, 200 with respect to a given space of coverage within the network 101. The software that is implemented on the controller device 300 can correspond to, for example, an application, a suite of applications, or alternatively to an operating system level functionality. The controller device 300 can share an application framework or interface with other devices of the network. For example, each of the controller device 300 and the various audio output devices 120, 122, 124, 126, 200 that are employed on the network 101 can implement a media platform, such as provided by QUALCOMM ALLPLAY media platform.

As an addition or alternative, in some embodiments, the controller device 300 operates to detect and process transmissions for purpose of estimating a proximity of the controller device to individual audio output devices 120, 122, 124, 126, 200 that are operating on the network 101. With such proximity information, the controller device 300 can operate to calibrate an output of one or more of the audio output devices 120, 122, 124, 126, 200 on the network 101.

In some embodiments, the controller device 300 includes a user interface 310, audio output device control logic ("AOD control logic") 320, device position logic 330, and an audio output device interface 340. The user interface 310 can display prompts that guide the user into providing input that identifies basic input information 301 about the audio output devices 120, 122, 124, 126, 200 employed on the network 101. For example, the user interface 310 can display a virtualized room or space within the dwelling, and provide features that enable the user to indicate, among other information, (i) a number of audio output devices 120, 122, 124, 126, 200 employed on the network 101, and (ii) a general location for a given audio output device 120, 122, 124, 126, 200, which can be labeled. The user interface 310 can also execute to prompt the user to provide input information 301 that identifies additional information about the audio output devices, such as a manufacturer, capability, or connectivity status. The user interface 310 can output device position information 311, which can identify the number of audio output devices and their relative position in a space represented through the user interface 310. The device position logic 330 can receive the position information 311, and optionally generate one or more response queries 313 that can configure content on the user interface 310 to, for example, prompt the user to provide additional input information 301.

By way of example, the response queries 313 can prompt the user to provide additional input information 301 that can approximate the length or total distance between the audio output devices 120, 122, 124 on the network 101, so as to provide dimensionality to the virtualized representation of the space within the network. Still further, the response query 313 can prompt the user to specify audio output devices 120, 122, 124, 126, 200 for different rooms of a dwelling of the network 101. More generally, the response query 313 can prompt the user interface 310 to display content for enabling the user to define different rooms or spaces of the dwelling covered by the network 101. In some variations, the input information 301 can prompt the user into entering information corresponding to (i) group size information 309, corresponding to a number of audio output devices on the network 101, and (ii) device position information 311, which identifies a general or relative location of audio output devices 120, 122, 124, 126, 200 within the space of the network 101 (e.g., within the individual rooms). Still further, while some embodiments provide for the user interface 310 to prompt the user for input information 301, other embodiments provide for the user interface 310 to guide the user into selecting one or more configurations affecting the audio output devices 120, 122, 124, 126, 200, including input for selecting channel configuration 333.

In some embodiments, the device position logic 330 can operate to determine a set of the channel configurations 333 based at least in part on the group size information 309 and the device position information 311 of the individual audio output devices 120, 122, 124, 126, 200. The channel configuration 333 can specify a speaker configuration layout ("C. Lay") 337, such as 3, 5, 7, (or more) Surround Sound layout, or Dolby 5.1 or 7.1 speaker layout. The channel configurations 333 for the audio output devices 120, 122, 124, 126, 200 can include channel assignments 339 ("Chan. Ass. 339") for individual audio output devices. In some variations, the configuration layout 337 can be based on one or more criterion, such as the number of audio output devices 120, 122, 124, 126, 200 (e.g., provided with group size information 309) and/or the positioning of the audio output devices 120, 122, 124, 126, 200 (e.g., as specified from device position information 311). In some variations, configuration layout 337 can be selected by default. In another variation, the user can be provided a selection feature via the user interface 310 in order to make selection of a particular configuration layout 337. A configuration library 329 can retain information about different possible configuration layouts 337, and provide a mechanism for selecting one or more configuration layouts 337 based on the group size information 309 and/or the device position information 311 of each audio output devices 120, 122, 124, 126, 200. The device position information 311 of each audio output device 120, 122, 124, 126, 200 can be also indicated by input information 301 received via the user interface 310), as well as other input from the user (e.g., input that is indicative of a preference of the user). The channel assignments 339 can be made programmatically, based on, for example, the configuration layout 337, the group size information 309, and/or device position information 311 of the audio output devices 120, 122, 124, 126, 200 in the space of the dwelling.

The channel configuration 333 can be communicated to the audio output interface 340. As mentioned with other examples, the audio output interface 340 can provide an application programming interface that enables the controller device 300 to communicate with other connected devices of the network 101. For example, the audio output interface 340 can be used for wireless peer-to-peer communications, such as provided through a Wi-Fi Direct medium. In some variations, the audio output interface 340 communicates the channel configurations 333 to the audio output device 120, 200 that is selected to be the leader for a particular session on the network.

As mentioned, in some embodiments, the controller device 300 includes functionality for calibrating an output of the audio output devices 120, 122, 124, 126, 200 on the network 101 based on a location of the user at a given moment. As the location of the user changes, the controller device 300 can implement functionality to dynamically control an output of individual audio output devices 120, 122, 124, 126, 200 on the network 101, so that the audio experience of the user equally reflects the output from individual audio output devices.

In some embodiments, the controller device 300 includes an acoustic input interface 306, a timing analysis component 312, and the audio output device control logic 320. The audio output device control logic 320 can include a delay (or latency) control 322 and volume control 324. The acoustic input interface 306 can include a programming component that interfaces with a microphone of a mobile computing device on which controller device 300 is implemented. In particular, the acoustic input interface 306 can be configured to detect reference acoustic reference transmissions ("AREFTR") 361 from each of the active audio output devices 120, 122, 124, 126, 200 on the network 101. The acoustic input interface 306 can include logic that recognizes, for example, a predetermined characteristic of the acoustic reference transmissions 361, such as a signal pattern.

In some embodiments, each audio output device 120, 122, 124, 126, 200 transmits a locally unique acoustic reference transmission 361, signaling an identifier for the transmitting device. Depending on implementation, the acoustic reference transmission 361 of each audio output device 120, 122, 124, 126, 200 can be in the audible or inaudible range. In some embodiments, the acoustic reference transmission 361 of the each audio output device 120, 122, 124, 126, 200 is communicated at a frequency range that is detectable to a microphone of the mobile computing device on which the controller device 300 is provided. Additionally, each of the audio output devices 120, 122, 124, 126, 200 communicates a corresponding acoustic reference transmission 361, representing a portion (e.g., a frame or series of frames) of an audio content (e.g., song) that is outputted from each of the respective audio output devices.

The acoustic input interface 306 can include logic to detect the acoustic reference transmission 361 from each of the audio output devices 120, 122, 124, 126, 200. The acoustic input interface 306 can also compare the arrival time 363 of each of the acoustic reference transmissions 361 in order to determine a delay or other difference between the arrival times of the acoustic reference transmissions from different audio output devices 120, 122, 124, 126, 200 on the network 101. By way of example, embodiments recognize that it takes sound slightly less than 1 millisecond to travel 1 foot, and that if the user moves by relatively small amounts (e.g., one foot), a detectable delay may result that affects the quality of the user experience in listening to the collective audio output from the audio output system 100.

The timing analysis component 312 can analyze the arrival time 363 of each of the acoustic reference transmissions 361 in order to detect sufficiently significant variations amongst the arrival times 363 that are attributed to the individual audio output devices 120, 122, 124, 126, 200. The difference in arrival times 363 can be indicative of user location, and more specifically, of a relative location or proximity of the user to individual audio output devices 120, 122, 124, 126, 200 of the system.

In some variations, a contextual analysis component 314 can also be implemented in connection with the timing analysis component 312. The contextual analysis component 314 can determine contextual information from timing differentials (as identified by arrival times 363) of the acoustic reference transmissions 361 from the different audio output devices 120, 122, 124, 126, 200. In some variations, the contextual analysis component 314 can detect a trend or event from the movement of the user within a network space or region. For example, the contextual analysis component 314 can reference known information about the location of individual audio output devices 120, 122, 124, 126, 200 (which can be approximated from input information 301 and/or from location detection technology) in order to determine that the user has switched rooms. Accordingly, one determination that can be made from the contextual analysis component 314 includes the determination to power down or up select audio output devices 120, 122, 124, 126, 200 based on the determined location of the user. The contextual analysis component 314 can signal a contextual determination ("CD") 315 to the audio output device control logic 320, which in turn can send control commands ("CC") 321 to select audio output devices 120, 122, 124, 126, 200 for purpose of powering those audio output devices up or down based on contextual determinations 315. By way of example, the contextual determinations 315 can include information that locates a particular audio output device in one room or floor and the user in another room or floor of the dwelling.

Additionally, timing analysis component 312 can generate a timing parameter ("TP") 317 which is indicative of a difference in the arrival times 363 of one or more acoustic reference transmissions 361. The delay control 322 of the audio output device control logic 320 can utilize the timing parameter 317 to generate a delay command ("DC") 323 for one or more of the audio output devices 120, 122, 124, 126, 200. By way of example, when output provided from the acoustic input interface 306 indicates that the user has become proximate to one of the audio output devices 120, 122, 124, 126, 200 and distal to another of the audio output devices 120, 122, 124, 126, 200, the proximate audio output device can be provided the delay command 323. The delay command 323 can serve to slow down or delay the output of the proximate audio output device 120, 122, 124, 126, 200. The delay caused to the proximate audio output device 120, 122, 124, 126, 200 can be based on the detected difference in the arrival times 363 of the acoustic reference transmissions 361 from the distal and proximate audio output devices 120, 122, 124, 126, 200. The delay command 323 can generate a delay that substantially equalizes the arrival times 363 of the proximate and distal audio output devices 120, 122, 124, 126, 200.

Still further, the volume control 324 of the audio output device control logic 320 can use the timing parameter 317 to determine an adjustment to the volume of one or more of the audio output devices 120, 122, 124, with the purpose of having the user experience a same volume from all of the audio output devices 120, 122, 124, 126, 200 regardless of the fact that the user may move or otherwise become close to one or more of the audio output devices at the expense of another. In some implementations, the volume control 324 can generate a volume command ("VC") 325 to cause one of (i) a decreasing adjustment to the volume of a proximate audio output device 120, 122, 124, 126, 200 in response to user movement, and (ii) an increasing adjustment to the volume of a distal audio output device 120, 122, 124, 126, 200 in response to the user movement, or (iii) a combination of increasing and decreasing volume of the distal and proximate audio output device 120, 122, 124, 126, 200 respectively, in response to user movement. The particular volume command 325 that is selected can be based on, for example, a default setting or a user preference.

The audio output interface 340 can communicate one or more of the control command 321, delay command 323, and/or volume command 325 to the connected audio output devices 120, 122, 124, 126, 200 of the network 101. In particular, the delay command 323 and/or volume command 325 can be generated in response to continued polling or checking of user location as determined from the mobile computing device of controller device 300. In this way, the delay commands 323 and/or volume commands 325 can provide a mechanism to calibrate output characteristics of individual audio output devices 120, 122, 124, 126, 200 on the network 101. Among other benefits, the calibration functionality enables the user to experience audio content as equal contributions from multiple audio output devices 120, 122, 124, 126, 200 of the network 101 that are spaced non-equidistantly. The calibration functionality also enables the user to experience audio content from multiple contributing audio output devices 120, 122, 124, 126, 200 equally even when the user is in motion, or when the user is measurably closer to one audio output device over another. The calibration functionality such as described can also enable the collective audio output to be equalized in contributions from the different audio output devices 120, 122, 124, 126, 200 that are generating output on the network 101, despite differences existing in the manufacturing, quality, or capability of the individual audio output devices.

Figure 4:
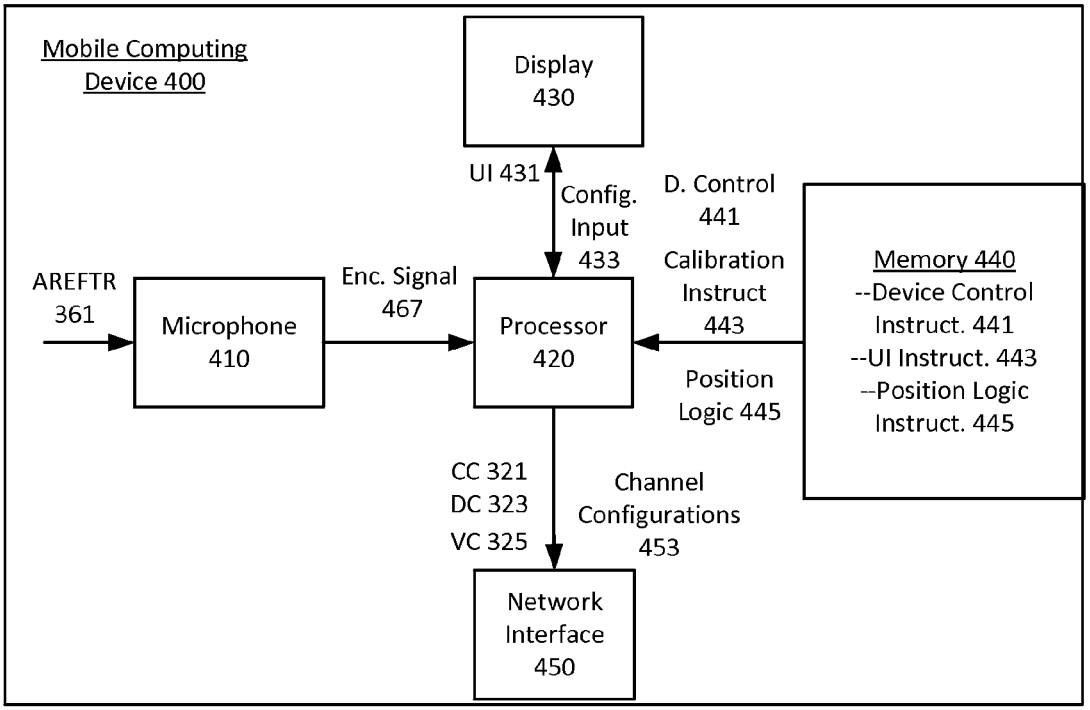
FIG. 4 illustrates a mobile computing device on which various embodiments can be implemented.

FIG. 4 illustrates a mobile computing device on which various embodiments can be implemented. A mobile computing device 400 of FIG. 4 can be used to implement controller device 110, 300, such as described with an example of FIG. 1 and FIG. 3. The mobile computing device 400 may include a microphone 410, a processor 420, a display 430, a memory 440, and a network interface 450.

With reference to FIGS. 1-4, the memory 440 may store instructions for implementing various functionality described with, for example, controller device 110, 300. In some variations, the memory 440 stores device control instructions ("Device Control Instruct.") 441, which may be executed by the processor 420 in connection with control and calibration functionality (e.g., as described with an example of FIG. 3). The microphone 410 of the mobile computing device 400 receives the acoustic reference transmissions ("AREFTR") 361 from the individual audio output devices 120, 122, 124, 126, 200. The acoustic reference transmissions 361 may be received as encoded signals 467 ("Enc. Signal"), and may include data that identifies the particular audio output device 120, 122, 124, 126 from which the acoustic reference transmission 361 originated. The processor 420 may execute the device control instructions 441 in order to (i) collect the acoustic reference transmissions 361 from the different audio output devices 120, 122, 124, 126 for a given point in time, and (ii) implement timing analysis component 312 to determine timing parameters 317 reflecting differences in the arrival times 363 of the acoustic reference transmissions 361.

According to some embodiments, the processor 420 can execute the device control instructions 441 in order to determine calibration commands based at least in part on the determined timing parameters 317. Furthermore, the processor 420 can use the network interface 450 to communicate calibration commands to one or more audio output devices 120, 122, 124, 126, 200 on the network 101 of the mobile computing device 400. The calibration commands can include, for example, delay commands ("DC") 323, which cause specific audio output devices 120, 122, 124, 126, 200 to selectively delay or otherwise adjust timing of their respective outputs in order to calibrate the arrival time of a given segment of audio content to the user. As an addition or variation, the calibration commands can include volume commands ("VC") 325 which adjust the volume of individual audio output devices 120, 122, 124, 126, 200 up or down based on, for example, a proximity of the user to one audio output device 120, 122, 124, 126, 200 as opposed to another.

According to some variations, the processor 420 can also execute the device control instructions 441 in order to implement contextual analysis component 314 (as described with an example of FIG. 3) and make contextual determinations 315. From the contextual determinations 315, control commands ("CC") 321 can be communicated to selectively power audio output devices 120, 122, 124, 126, 200 on or off based on the location of the user relative to individual audio output devices. The contextual analysis component 314 can make the contextual determinations 315 based on contextual information, such as, for example, information defining the spacing, leveling, or segmentation (e.g., rooms) of the dwelling of network 101.

As an addition or alternative, the memory 440 can also store user interface instructions ("UI Instruct.") 443. The processor 420 can execute the user interface instructions 443 in order to generate a user interface ("UI") 431 on the display 430. The user interface 431 can provide the user with prompts and other interfaces to facilitate the user in providing input information 301 about the audio output devices 120, 122, 124, 126, 200 that are in use on the network 101. In particular, the input information 301 received through the user interface 431 can include configuration input ("Con-FIG. Input") 433, including (i) the group size information 309 (FIG. 3), which identifies a number of audio output devices 120, 122, 124, 126, 200 on the network 101, (ii) device position information 311, including a location indication for one or more of the audio output devices 120, 122, 124, 126, 200, and/or (iii) a selected or preferred layout. In one example, the mobile computing device 400 determines the channel configurations 453 based at least in part on a configuration input of the user. The configuration input can be determined through user interaction with the user interface 431 provided on the display 430.

Still further, the memory 440 can include position logic instructions ("Position Logic Instruct.") 445, which when executed by the processor 420, result in the processor 420 generating channel configurations 453. As described with some other examples, channel configurations 453 can include one or more the following: (i) an audio output device layout or scheme, and/or (ii) a channel assignment for each audio output device 120, 122, 124, 126, 200 on the network 101, based on the selected device layout. The position logic instructions 445 can determine channel configurations 453 based on additional information, such as input information 301 provided from the user, and/or information known about a particular type or model of one or more of the audio output devices 120, 122, 124, 126, 200. For example, a user may enter information about a specific audio output device using the user interface 431, and the capability known for the particular audio output device may favor use of that device for a particular location are channel assignment.

Figure 5:
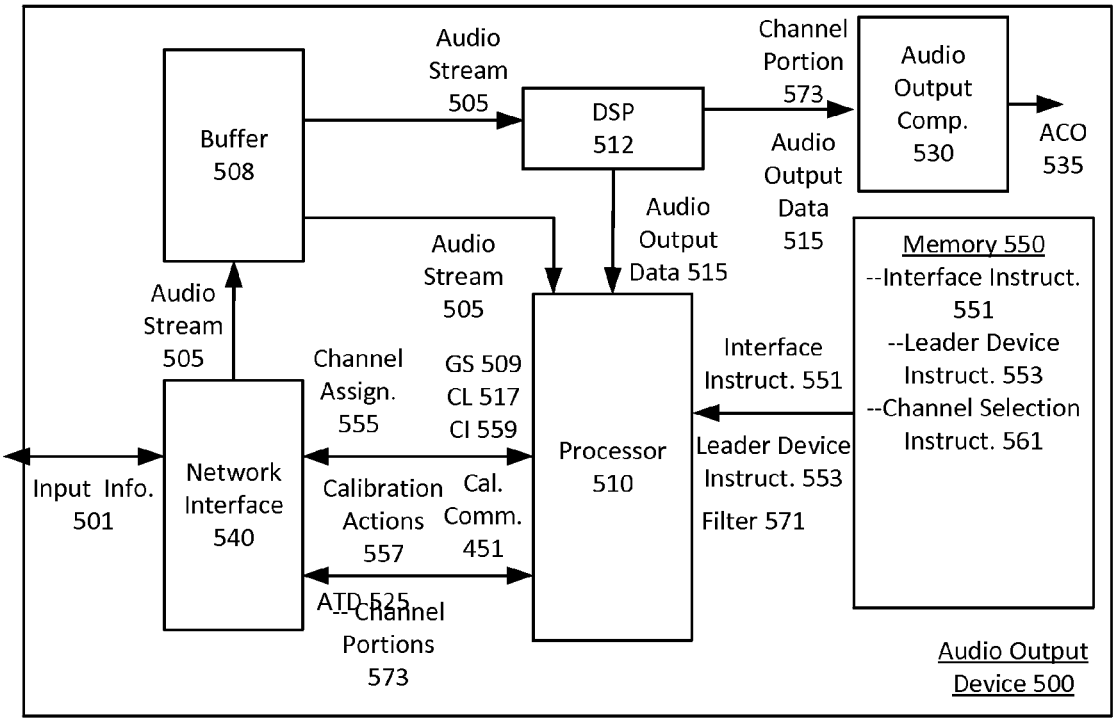
FIG. 5 illustrates an audio output device on which various embodiments can be implemented.

FIG. 5 illustrates an audio output device on which various embodiments can be implemented. In particular, an example of FIG. 5 illustrates an audio output device 500 that can also optionally operate as a leader device (e.g., 120, 200), such as described with an example of FIG. 1 or FIG. 2.

With reference to FIGS. 1-5, in more detail, the audio output device 500 includes a buffer 508, a processor 510, an audio output component 530, a network interface 540, and a memory 550. In variations, the audio output device 500 includes a digital signal processor (DSP) 512. The memory 550 can store instructions for execution by the processor 510, including interface instructions 551 and/or leader device instructions 553. When operating on the network 101, the processor 510 can execute interface instructions 551 in order to receive an incoming audio stream 505 at the buffer 508 via the network interface 540. In some implementations, (i) at least a portion of the audio stream 505 is directed to the audio output component 530, which generates an audio content output ("ACO") 535, and (ii) transmit at least portions of the audio stream 505 to other audio output devices 120, 122, 124, 126, 200. In some embodiments, the DSP 512 processes the audio stream 505 in to enhanced audio output data 515, which can, for example, structure the audio stream 505 into delineable channeled portions that can be readily filtered at the playback location. The audio output component 530 can receive audio output data 515 from the DSP 512. In variations, the audio output component 530 receives the audio stream 505 from the buffer 508. Still further, the audio output component 530 can receive a channel portion 573 of the audio stream 505, based on the channel assignment as determined by the processor 510. The audio output component 530 can transform the audio output data 515 (or audio stream 505) into sound which is emitted from the audio output device 500 onto the physical space of the network 101.

Additionally, as a leader, the processor 510 of the audio output device 500 can execute leader device instructions 553 in order to (i) determine and communicate channel assignments 555 to other audio output devices 120, 122, 124, 126, 200 on the network 101, (ii) distribute the audio stream 505 (or portions thereof) to the other audio output devices 120, 122, 124, 126, 200, and/or (iii) implement or otherwise communicate calibration actions 557 that affect the generation of audio output on the other audio output devices 120, 122, 124, 126, 200. In variations, the processor 510 can execute the leader device instructions 553 to utilize and distribute the enhanced form of the audio stream 505 from the DSP 512, shown as the audio output data 515.

The audio output device 500 can also execute the leader device instructions 553 to receive input information 501 from the controller device 110, 300. Among other items, the input information 501 can include group size information ("GS") 509, channel layout information ("CL") 517 (e.g., positioning of the individual audio output devices about a dwelling in accordance with Dolby 5.1/7.1 etc.), and configuration input ("CI") 559. The input information 501 can be received by, for example, user input provided through an interaction with the user interface 310.

In some implementations, the channel assignments 555 can be determined by the controller device 110, 300 and received by the audio output device 500 the network interface 540. In some variations, the channel assignments 555 can be determined by channel selection instructions 561 executing on the audio output device 500. The channel selection instructions 561 can utilize input information 501, including (i) group size information 509, corresponding to a number of audio output devices 120, 122, 124, 126, 200, 500, (ii) the channel layout 517, and (iii) a general configuration of the audio output devices 120, 122, 124, 126, 200, 500, provided as configuration input 559. The channel selection instructions 561 utilize the various inputs in order to determine the channel assignments 555 for individual audio output devices 120, 122, 124, 126, 200, 500. The inputs for the channel selection instructions 561 can be received over the network interface 540 from, for example, the mobile computing device 400 as the controller device 110, 300.

Some embodiments provides for the audio output device 500 to distribute, as the leader, audio transmission data ("ATD") 525 to other audio output devices 120, 122, 124, 126, 200, 500 using the network interface 540. Depending on implementation, the audio transmission data 525 can correspond to (i) the full audio stream 505, which can be filtered by the other audio output devices 120, 122, 124, 126, 200, 500 which receive the audio stream 505; (ii) the audio output data 515, which structures the full audio stream 505 into pre-determined and delineable channeled portions that can be readily filtered at the playback location; and/or (iii) separated channel portions 573, which can be individually transmitted to specific audio output devices based on the channel assignment of the audio output devices 120, 122, 124, 126, 200, 500.

In some embodiments, the selection of a leader amongst the audio output devices 120, 122, 124, 126, 200, 500 can be a modal implementation, which can be dynamically implemented by the controller device 110, 300. In alternative modes, the audio output device 120, 122, 124, 126, 200, 500 that is the leader can be replaced by, for example, the source of the audio stream, the access point 102, the mobile computing device 400 acting as the controller device 110, 300 (which can also act as the source of the content), or another one of the audio output devices 120, 122, 124, 126. In other variations, the designation of one audio output device 120, 122, 124, 126, 200, 500 as the leader can be subject to change based on selection logic on the controller device 110, 300. For example, the controller device 110, 300 can execute selection logic to change the leader in response to an event or condition, such as presence of low bandwidth at the originally selected leader device.

According to some embodiments, the audio stream 505 can be received over the network interface 540, then buffered at buffer 508 and processed. The input audio stream 505 can represent a full stream, without any delineation or segmentation of channels from the greater content. The processor 510 (or DSP 512 if used) can execute filtering logic ("filter") 571 in order to create multiple channel portions 573 of the audio stream 505. Each of the channel portions 573 can correspond to one of the channels of the determined channel configuration. Specifically, the audio stream 505 can be filtered into multiple channel portions 573, with each channel portion 573 being designated for a particular channel that is assigned to one of the audio output devices 120, 122, 124, 126, 200, 500 on the network 101. The channel portions 573 of the audio stream 505 can then be transmitted to the other audio output devices 122, 124, 126, 200 using the network interface 540.

With regard to the calibration actions, the audio output device 500 may receive calibration commands ("Cal. Comm.") 552 from the mobile computing device 400, and then implement the calibration commands 552 as calibration actions 557. The calibration actions 557 may correspond to or be based on the calibration commands 552. The calibration actions 557 may be implemented directly through distribution of the audio transmission data 525 or through communication with the other audio output devices 120, 122, 124, 126 via the network interface 540. In some variations, the audio output device 500 receives calibration related measurements and data from the mobile computing device 400, such as the timing parameter 317. In variations, the audio output device 500 may also include logic to determine calibration actions 557 that include or correspond to calibration commands 552 (delay, volume, etc.), based on the measurements and data of the mobile computing device (e.g., different in arrival times for a common audio segment, timing parameters, etc.).

Methodology

Figure 6:
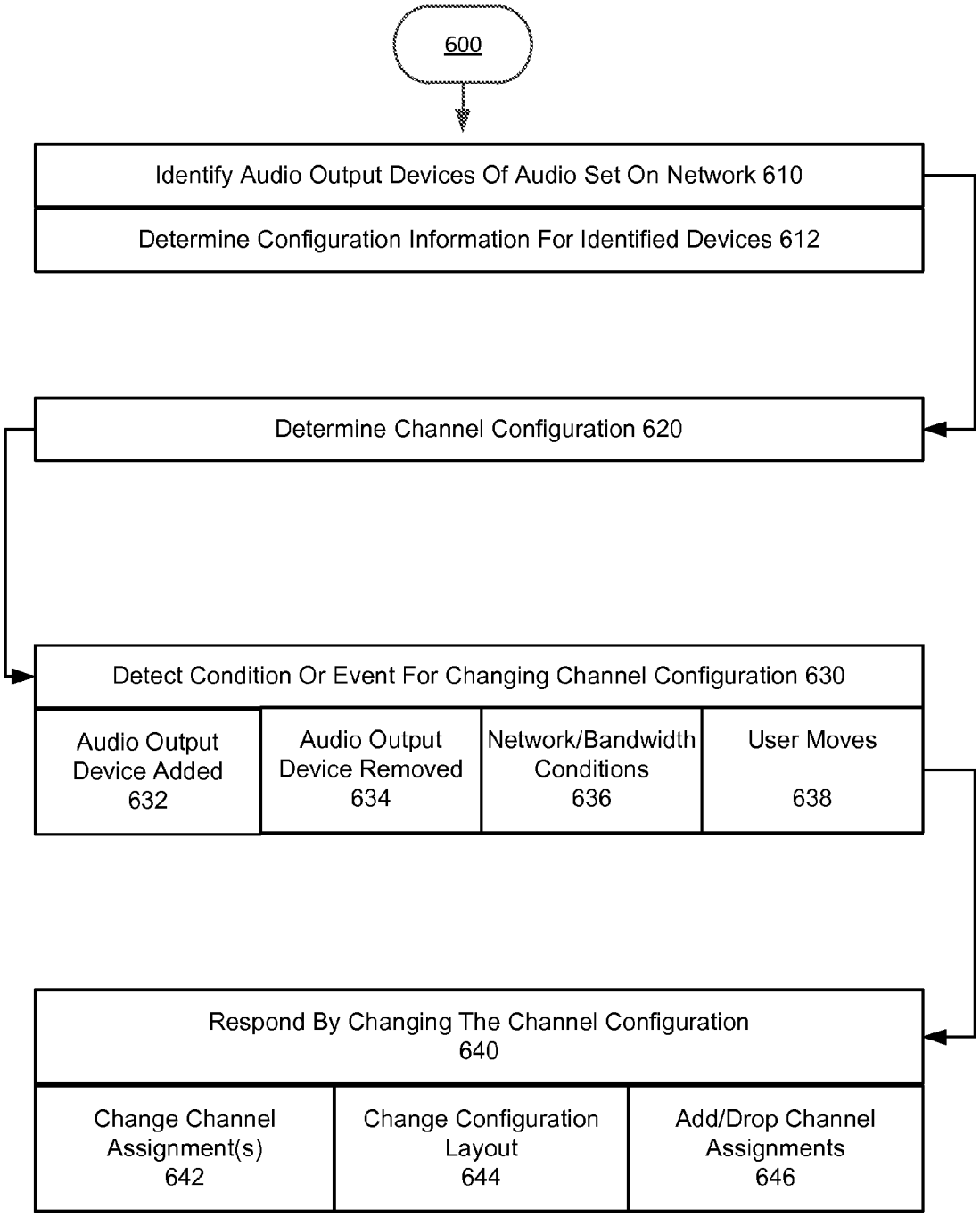
FIG. 6 illustrates a method for dynamically determining and implementing channel configurations for a network-based audio system, according to various embodiments.
Figure 7:
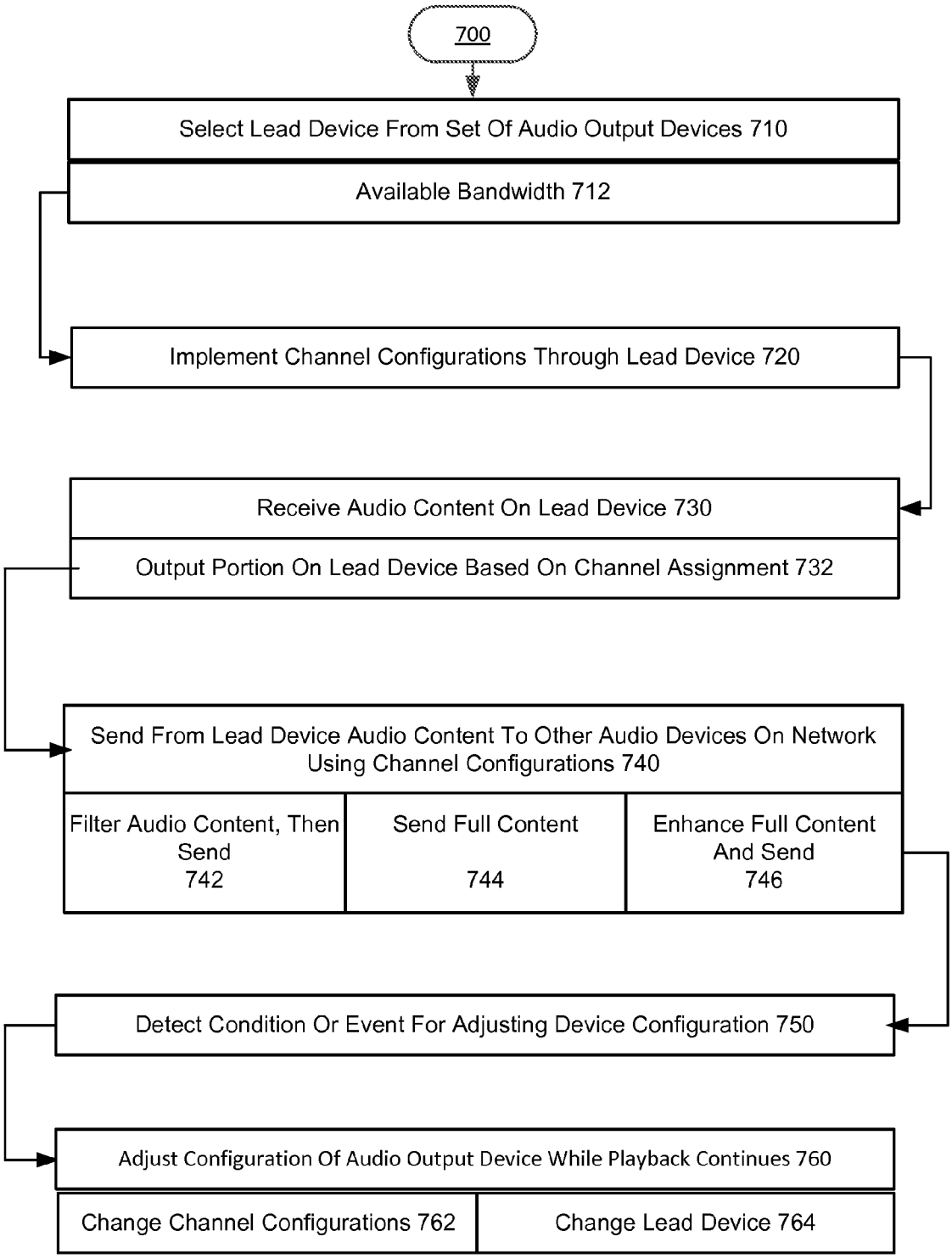
FIG. 7 illustrates a method for operating an audio output device as a leader device when distributing audio content to other audio output devices on a network, according to various embodiments.
Figure 8:
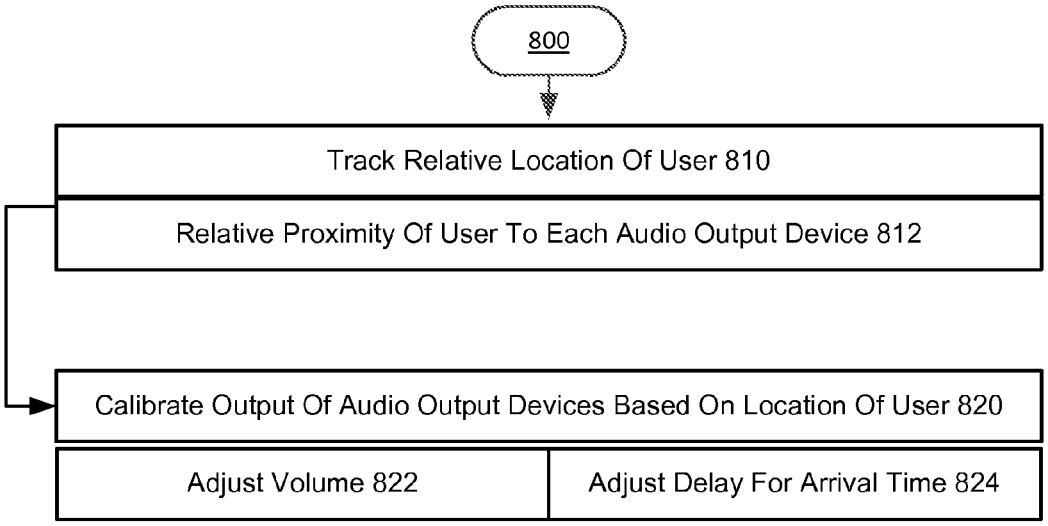
FIG. 8 illustrates a method for calibrating an output of multiple audio output components on a network based on a relative position of a user, according to various embodiments.
Figure 9:
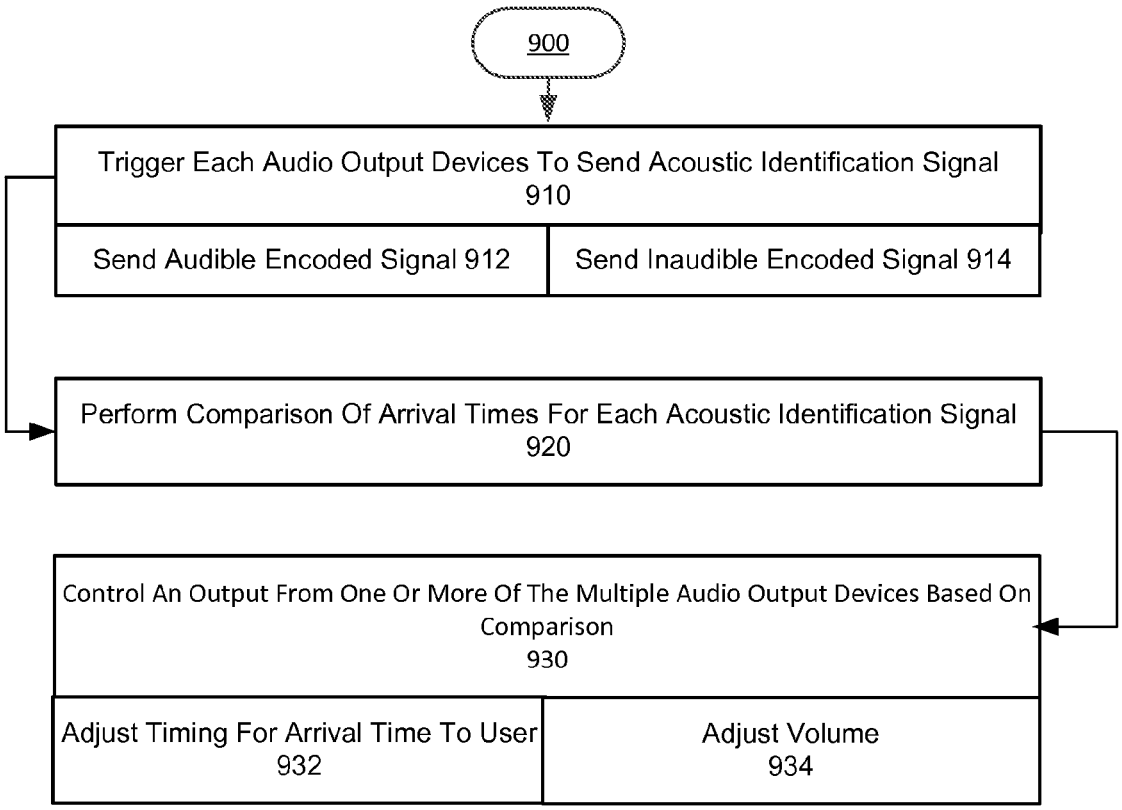
FIG. 9 illustrates a method for calibrating an audio output device based on a position of a user, in accordance with various embodiments.
Figure 10:
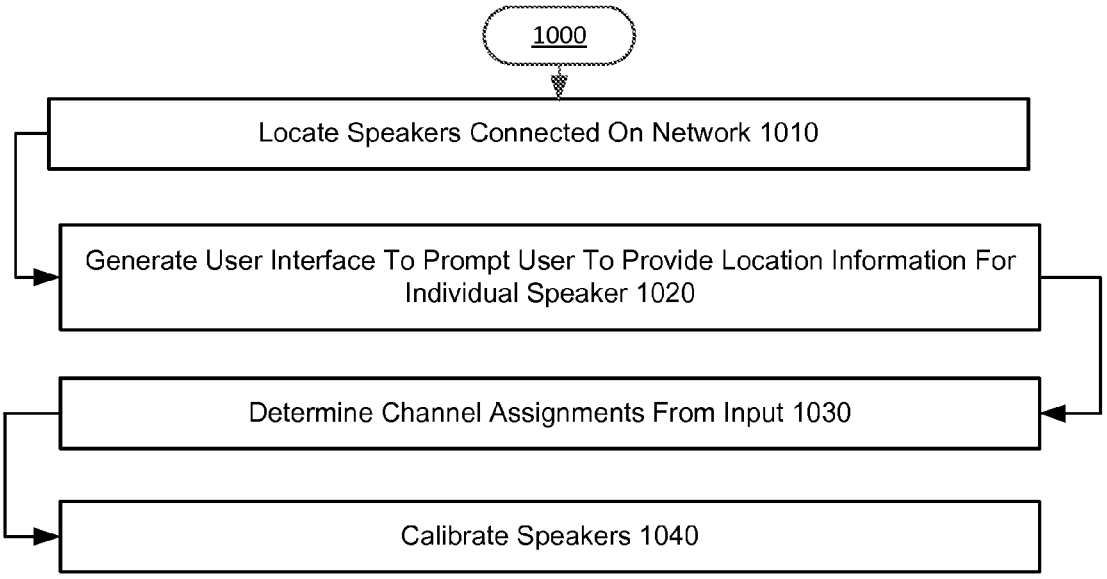
FIG. 10 illustrates a method for implementing a user interface to initiate dynamic configuration of a network-based audio system, according to various embodiments.

FIG. 6 illustrates a method 600 for dynamically determining and implementing channel configurations for a network-based audio system, according to various embodiments. FIG. 7 illustrates a method 700 for operating an audio output device as a leader device when distributing audio content to other audio output devices on a network, according to various embodiments. FIG. 8 illustrates a method 800 for calibrating an output of multiple audio output components on a network based on a relative position of a user, according to various embodiments. FIG. 9 illustrates a method 900 for calibrating an audio output device based on a position of a user, in accordance with various embodiments. FIG. 10 illustrates a method 1000 for implementing a user interface to initiate dynamic configuration of a network-based audio system, according to various. Example methods such as provided by FIG. 6 through FIG. 10 can be performed using components such as described with examples of FIG. 1 through FIG. 5. Accordingly, reference may be made to elements of FIG. 1 through FIG. 5 for purpose of describing suitable components for performing a step or sub-step being described.

With reference to FIGS. 1-6, a set of audio output devices 120, 122, 124, 126, 200, 500 for a given network 101 can be identified by a controller device 110, 300 (610). In some implementations, the audio output devices 120, 122, 124, 126, 200, 500 can be identified by input information from a user. In some implementations, input information 301 can be provided through the user interface 310 of the controller device 110, which can be provided on a mobile computing device 400. In a variation, the audio output devices 120, 122, 124, 126, 200, 500 that are connected on the network 101 can be identified programmatically, using, for example, object tracking and detection technology. For example, the audio output devices 120, 122, 124, 126, 200, 500 of the network 101 can be equipped with a receiver for receiving transmissions of ultrasonic acoustic waves. The controller device 110, 300 can transmit the ultrasonic acoustic waves to the individual audio output devices 120, 122, 124, 126, 200, and the audio output devices 120, 122, 124, 126, 200 can include programming or logic to detect the ultrasonic acoustic waves. The ultrasonic acoustic waves can provide for use of a dimensional parameter based on the received transmission.

Additional configuration information can also be determined for the identified audio output devices 120, 122, 124, 126, 200, 500 of the network 101 (612). The additional configuration information can include a selected device layout (e.g., 5.1 arrangement, 7.1 arrangement etc.), as well as a relative location of the individual audio output devices 120, 122, 124, 126, 200, 500 about a physical region of the network 101. For example, a user can specify the approximate location of individual audio output devices 120, 122, 124, 126, 200, 500 using a virtual interface of a generic room, provided through the user interface 310 of the controller device 110, 300.

Once the audio output devices 120, 122, 124, 126, 200, 500 are identified and other configuration information is determined, the channel configuration for the audio output devices 120, 122, 124, 126, 200, 500 can be determined (620). As described with other examples, the channel configuration can specify channel assignment for identified audio output devices 120, 122, 124, 126, 200, 500. In some examples, the channel configuration can be determined from, for example, the mobile computing device 400 on which the controller device 110, 300 is implemented. In a variation, the channel configuration can be determined from the audio output device 120, 200, 500 that is selected as the leader by the user and/or controller device 110, 300. Still further, in another variation, the channel configuration can be determined from multiple components, including the controller device 110, 300 or audio output device 120, 200, 500 that operates as the leader.

According to some embodiments, when the audio output devices 120, 122, 124, 126, 200, 500 are in use, an event or condition can be detected requiring a dynamic or on-the-fly change to the configuration of the audio output devices (630). In some implementations, the occurrence of the condition or event can correspond to a new audio output device being introduced to the network 101 (632). Alternatively, the condition or event can correspond to one of the existing audio output devices 120, 122, 124, 126, 200 being removed or taken down from the network 101 (634). Still further, there may be a change in a network bandwidth (636), resulting in some audio output devices 120, 122, 124, 126, 200, 500 having their bandwidth changed for better or worse as compared to other audio output devices 120, 122, 124, 126, 200, 500. As another variation, the audio content being played by the various audio output devices 120, 122, 124, 126, 200, 500 can change. For example, the channel configuration may merit change if the audio content shifts from having a relatively normal or low bit count to having a relatively high bit count.

Still further, the network condition or event can correspond to the user moving about a region where the audio output devices 120, 122, 124, 126, 200, 500 are in use and present (638). As described, some embodiments provide that when the user moves about, the movement of the user is detected, and one or more calibration actions may take place to equalize the experience of audio generated by the audio output devices 120, 122, 124, 126, 200, 500 on the network 101. As an addition or variation, one response to the user moving in the physical region of the audio output devices 120, 122, 124, 126, 200, 500 can be that the channel configuration is altered to accommodate the movement of the user.

In response to detecting the event or condition, the controller device 110, 300 and/or audio output device 120, 200, 500 that is the leader can respond by changing the channel configuration (640). More specifically, in some implementations, the channel configuration can be changed by altering the various channel assignments (642) to accommodate more or fewer audio output devices 120, 122, 124, 126, 200, 500 (in the event that an audio output device is added or subtracted from the network 101). Additionally the channel configuration can be changed by altering a layout so as to favor the change to, for example, the number of the audio output devices 120, 122, 124, 126, 200, 500 (644). Still further, the change in channel configuration can be responsive to the addition or deletion of the channel assignment (646).

With reference to FIGS. 1-7, a leader of the audio output devices 120, 200, 500 is selected (710). The selection of the audio output device 120, 200, 500 that is the leader can also be dynamic, in that some variations provide that the audio output device that is the leader can be selected and/or changed by the controller device 110, 300. By way of example, the audio output device 120, 200, 500 that is selected as the leader can change as a result of variations to the bandwidth available to that device (712), particularly as compared to the other audio output devices 120, 122, 124, 126, 200, 500 on the network 101.

According to some embodiments, some or all of the channel configurations can be implemented through the audio output device 120, 200, 500 that is the leader (720). Still further, the audio output device 120, 200, 500 that is the leader and/or controller device 110, 300 can combine to implement the various channel configurations for all of the audio output devices 120, 122, 124, 126, 200, 500. The channel configurations can also be determined from the controller device 110, 300 and then communicated to the audio output device 120, 200, 500 that operates as the leader. As described with other examples, the channel configurations can include channel assignments for each of the audio output devices 120, 122, 124, 126, 200. In some variations, the channel configurations can also include other information, such as a presumed layout for the audio output devices 120, 122, 124, 126, 200.

In operation, audio content can be received on the audio output device 120, 200, 500 that is the leader for distribution to other audio output devices 120, 122, 124, 126, 200, 500 of the network 101 (730). While receiving and distributing the audio content, the leader audio output device 120, 200, 500 can also output a portion of the audio content that is assigned to its own channel (732).

In some variations, the audio content is received on the audio output device 120, 200, 500 and then sent to the other audio output devices 120, 122, 124, 126, 200 that are on the network 101 in accordance with the determined channel configuration (740). In some implementations, the audio output device 120, 200, 500 that acts as the leader operates to filter the audio content for individual channels, and then sends the portion of the filtered audio to each of the other audio output devices 120, 122, 124, 126, 200 based on the channel assignment (742). As an addition or variation, the full audio content can be sent from the audio output device 120, 200, 500 to other audio output devices 122, 124, 126, 200 of the network 101. In such an implementation, the audio output devices 120, 122, 124, 126, 200, which receive the full audio content from the leader perform the filtering at the point of output, and further at the time just proceeding output (744). Further along the lines, some variations provide for the audio content to be augmented, and more specifically, processed on either the controller device 110, 300 or audio output device 120, 200, 500 that is the leader for purpose of generating structure in the audio content (746). The added structure can facilitate the other audio output devices 120, 122, 124, 126, 200 in performing filtering operations on a full audio content.

As mentioned with respect to the method 600, an event or condition is detected which initiates a change in the channel configuration and or other selections (e.g., selection of the particular leader device, or motive implementation etc.) (750). By way of example, the event or condition can correspond to a change in the bandwidth of some or all of the audio output devices 120, 122, 124, 126, 200, a change in the content being outputted (e.g., the bit value of the content), the addition or subtraction of an audio output device from the network 101, and/or movement by the user sufficient to trigger calibration actions.

In response to a detected event or condition, one or more processes can be triggered to dynamically adjust the channel configurations and other selections made by either the controller device 110, 300 or audio output device 120, 200, 500 operating as the leader (760). In some implementations, the controller device 110, 300 and/or audio output device 120, 200, 500 that is the leader can respond by adjusting the channel configurations of the respective audio output devices while the output continues on the network (762). The change in the channel configurations can include (i) changing the channel assignment of a given output device 120, 122, 124, 126, 200, (ii) creating or eliminating a channel assignment based on the addition or subtraction of an audio output device 120, 122, 124, 126, 200 to the network 101, and/or (iii) changing a selected layout for the audio output device 120, 122, 124, 126, 200 based on any one or more of user input, a change in the number of audio output devices 120, 122, 124, 126, 200, or other criteria. The channel configurations can be changed dynamically, so that the change to the channel configurations is relatively seamless and not interruptive to the listening experience of the user. For example, one or more changes can be made to the channel configurations while at least one or more of the audio output devices 120, 122, 124, 126, 200 continue to output audio content.

Other changes that can be implemented dynamically include the selection of the audio output device 120, 200, 500 that is to operate as the leader (764). For example, the audio output device 120, 200, 500 that operates as the leader can implement a mode change so that the other audio output devices 120, 122, 124, 126, 200 receive the audio content from the controller device 110, 300 or source, and not from the leader audio output device. Likewise another mode change can be made to select a new audio output device 120, 122, 124, 126, 200 as the leader, based on criteria such the amount of bandwidth available to the selected audio output device. Thus, for example, the selection of the audio output device 120, 122, 124, 126, 200 that acts as the leader can be dynamic and made on the fly. Likewise, other selections that can be made dynamically include: (i) the selection of the mode of operation, such as whether any one of the audio output device 120, 122, 124, 126, 200 can be used as leader after having been leader in the same session, (ii) whether the audio content is filtered or structured (e.g. with or without leader device), and/or (iii) whether the audio content is to be filtered or augmented for the other audio output devices 120, 122, 124, 126, 200 before transmission.

With reference to FIGS. 1-8, a location of a user can be tracked within the network environment based on measurements made by a mobile computing device 400 of the user when audio is being outputted by the audio output devices 120, 122, 124, 126, 200 (810). More specifically, a relative proximity of the mobile computing device 400 (which presumably is carried by the user) to one or more audio output devices 120, 122, 124, 126, 200 on the network 101 can be approximated (812). Based on the determined relative position of the user, as indicated by the user's mobile computing device, one or more output characteristics of the audio content can be calibrated to accommodate the presumed relative proximity of the user to the audio output devices 120, 122, 124, 126, 200 of the network 101 (820). As mentioned with other examples, the calibration can include controlling or otherwise adjusting the volume of one or more audio output devices 120, 122, 124, 126, 200 (822). As an addition or variation, the calibration can include adjusting or inserting delays into the output of audio content from one or more audio output devices 120, 122, 124, 126, 200 (824). The insertion of delays can be based on, for example, a proximity determination as between select audio output devices 120, 122, 124, 126, 200 and the user as compared to other devices connected to the same network 101.

With reference to FIGS. 1-9, each audio output device 120, 122, 124, 126, 200 is triggered to send an acoustic identification signal to the controller device 110, 300 (e.g., mobile computing device 400) (910). The acoustic identification signal can be an audible and encoded transmission that identifies the source of the acoustic transmission (912). In variations, the acoustic identification signal can be an inaudible and encoded transmission that is detectable to resources (e.g. microphone) of the mobile computing device on which the controller device 110, 300 is implemented (914).

The mobile computing device 400 can perform a comparison of arrival times for the acoustic identification signal transmitted from each audio output device 120, 122, 124, 126, 200 (920). Each acoustic identification signal can include a particular segment of the audio content being played back. For example, each acoustic identification signal can represent one or two frames of the audio content. Each audio output device 120, 122, 124, 126, 200 can transmit an acoustic identification signal for a common portion of the audio content being outputted on that device. The acoustic identification signal can provide a mechanism for the mobile computing device 400 of the user to make measurements that are indicative of a relative position of the mobile computing device to one or more other audio output devices 120, 122, 124, 126, 200.

In some implementations, the mobile computing device 400 includes software or other programmatic functionality to time stamp the incoming audio signal, extract the encoded identifier, and store the time stamp and identifier of the incoming audio signal for subsequent analysis. Each audio transmission can be encoded to coincide with a particular instance in time in the audio content. For example, a particular audio frame in a song can be selected for encoding by each audio output device 120, 122, 124, 126, 200, and each audio output device 120, 122, 124, 126, 200 can then output its portion of the audio frame when the song is being played. The microphone on the mobile computing device 400 can detect the encoded audio signals from each audio output device 120, 122, 124, 126, 200 and then record the arrival times and the identifier for each signal. Once all the transmissions for a given instant are recorded, a comparison of arrival times can be performed. The comparison can identify variation in the audio output device's arrival time, with the assumption that sound travels about 1 foot in 1 millisecond. If the arrival times reflect a discrepancy of more than 1 millisecond, then the arrival times indicate the mobile computing device 400 has moved a correlated amount. More specifically, the comparison of arrival times can indicate a proximity of the mobile computing device 400 of the user (on which the control device 110, 300 is implemented) relative to one or more of the audio output devices 120, 122, 124, 126, 200 that are connected to the network 101.

An output from one or more of the audio output devices 120, 122, 124, 126, 200 can be controlled in order to calibrate the audio output from all of the audio output devices, as well as to harmonize the user's experience (930). As described, some embodiments provide for the calibration actions to include (i) adjusting the timing for individual audio output devices 120, 122, 124, 126, 200 so that the arrival time of multiple audio output devices is substantially the same, at least from the perspective of the user (932); and (ii) adjusting the volume of an individual audio output device 120, 122, 124, 126, 200 so that the user experiences each of the device as being equal in volume, regardless of the distance between the user and the particular audio output device 120, 122, 124, 126, 200 (934).

With reference to FIGS. 1-10, a user interface 310 can be generated on a mobile computing device 400 on which the controller device 110, 300 is implemented, in order to enable the user to provide some or all of the configuration inputs for determining the channel configurations, as well as various other dynamic determinations (e.g., mode of operation, selection of the leader device, etc.).

According to various embodiments, the audio output devices 120, 122, 124, 126, 200 of the network can be located and linked (1010). As mentioned with other examples, each audio output device 120, 122, 124, 126, 200 can be capable of network communications, such as wireless communication (e.g., peer-to-peer wireless communications such as provided by Wi-Fi Direct). The audio output devices 120, 122, 124, 126, 200 can be linked, regardless of manufacturer or primary purpose. Still further, in variations, the audio output devices 120, 122, 124, 126, 200 can be heterogeneous, in terms of manufacturer, functionality, programmatic resources, and/or primary resource.

The user interface 310 can be generated to prompt or otherwise guide the user into providing information about the audio output devices 120, 122, 124, 126, 200 that are connected on the network 101 (1020). For example, a number of audio output devices 120, 122, 124, 126, 200 that are connected to the network 101 can be specified by user input provided through the user interface 310. Furthermore, the user can identify each audio output device 120, 122, 124, 126, 200, and further identify a relative location of each audio output device 120, 122, 124, 126, 200 in the user's dwelling or network space. For example, the user can be provided with the user interface 310 that depicts a general outline of a room (e.g., FIG. 11). The outline can be generic or include user-specified features (e.g., extra wall, rounded walls, etc.) The user can identify specific audio output devices 120, 122, 124, 126, 200 in the user's set, and then further indicate a location in the space or dwelling where the specific audio output devices are positioned.

Once the number of audio output devices and their respective location are generally identified, functionality provided by the audio output devices 120, 122, 124, 126, 200 can trigger determination of the channel assignments (1030). As described with other embodiments, in determining channel assignments, the number of audio output devices 120, 122, 124, 126, 200, the location of each audio output device, and the selected layout or configuration can serve as inputs for determining the channel assignments.

Once channel assignments and locations are determined, the calibration can be performed based on the relative location of the user (1040). An initial calibration can, for example, calibrate the arrival time and volume level of the media content output from each audio output device 120, 122, 124, 126, 200 based on an initial location of the user relative to the audio output devices. Subsequently the user can elect to have calibration performed periodically or repeatedly so to track the steps of the user in the dwelling or space.

Figure 11:
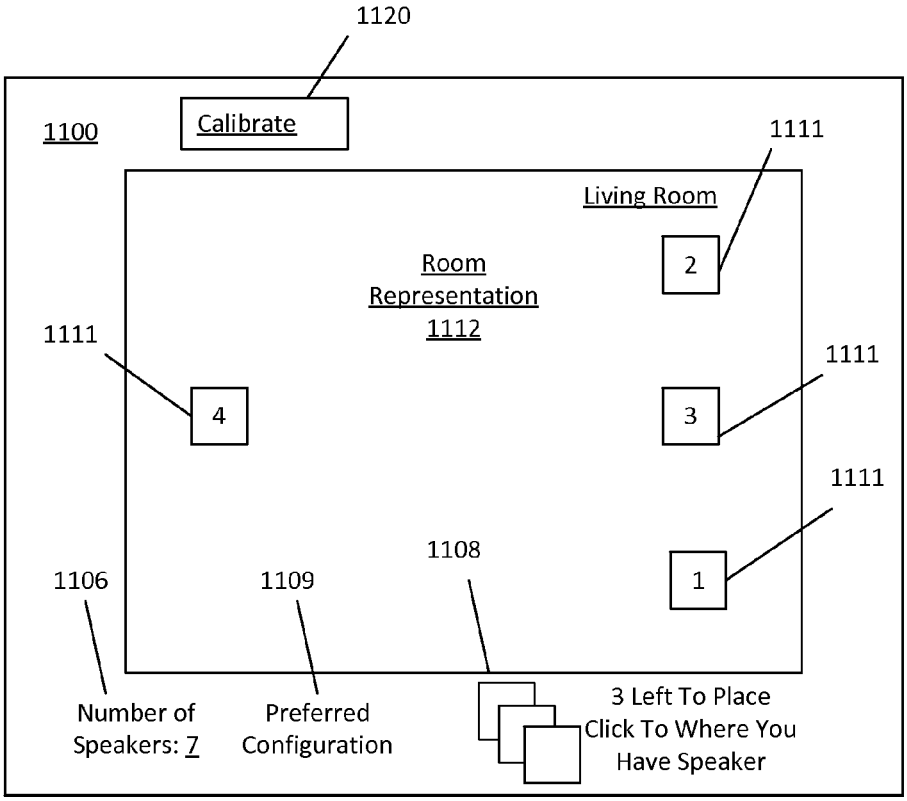
FIG. 11 illustrates a user interface for enabling speaker selection and assignment, according to various embodiments.

FIG. 11 illustrates a user interface 1100 for enabling speaker selection and assignment according to various embodiments. The user interface 1100 may be generated from an application or programming component executing on the mobile computing device 400. The user interface 1100 may, for example, include input functionality, including (i) number select feature 1106 for enabling the user to specify a number of audio output devices 120, 122, 124, 126 that are to be in use, and (ii) a layout selection 1109 feature to enable the user to select a preferred layout. Additionally, the user may be provided with placement functionality 1108 to enable the user to specify the location of individual audio output devices 120, 122, 124, 126 within a room representation 1112. (For example, the room representation 1112 may be a graphic representation of a room). The user may, for example, click and drag device representations 1111 onto the room representation 1112 to approximate the general location and orientation of the audio output devices 120, 122, 124, 126.

Once the audio output devices 120, 122, 124, 126, 200 are positioned, the user can select the calibration feature 1120 to initiate a calibration process such as described with the method 1000. The calibration feature 1120 can be triggered once to locate the user relative to the audio output devices 120, 122, 124, 126, 200. The calibration feature 1120 can correct any imprecision or error by the user in specifying the location of individual audio output devices 120, 122, 124, 126, 200. Additionally, the calibration feature can be implemented in a track mode, where the calibration is performed repeatedly to track whether the user moves.

Although illustrative embodiments have been described in detail herein with reference to the accompanying drawings, variations to specific embodiments and details are encompassed by this disclosure. It is intended that the scope of embodiments described herein be defined by claims and their equivalents. Furthermore, it is contemplated that a particular feature described, either individually or as part of various embodiments, can be combined with other individually described features, or parts of other embodiments. Thus, absence of describing combinations should not preclude the inventor(s) from claiming rights to such combinations.

What is claimed is:

1. A method for outputting audio signals, the method being performed by a computing device and comprising:
   receiving an acoustic reference signal from each of a plurality of audio output devices;
   comparing the acoustic reference signal from each of the plurality of audio output devices with the acoustic reference signals from others of the plurality of audio output devices;
   configuring one or more audio output characteristics of the plurality of audio output devices based at least in part on the comparison of the acoustic reference signals; and
   dynamically reconfiguring the audio output characteristics of at least one of the plurality of audio output devices in response to changes in the received acoustic reference signals.

2. The method of claim 1, wherein the configuring comprises:
   determining, from the comparison, a location of the computing device relative to each of the plurality of audio output devices; and
   configuring the one or more audio output characteristics based at least in part on the location of the computing device.

3. The method of claim 2, wherein the configuring further comprises:
   delaying audio signals output by at least one of the plurality of audio output devices to enable corresponding audio signals output from each of the plurality of audio output devices to arrive at the location of the computing device at substantially the same time.

4. The method of claim 2, wherein the configuring further comprises:
   adjusting a volume of audio signals output by at least one of the plurality of audio output devices based on the location of the computing device relative to the at least one of the plurality of audio output devices.

5. The method of claim 1, wherein each acoustic reference signal is an audible signal.

6. The method of claim 1, wherein each acoustic reference signal includes information identifying which of the plurality of audio output devices outputted the corresponding acoustic reference signal.

7. The method of claim 1, wherein each acoustic reference signal is an inaudible signal.

8. The method of claim 1, wherein the comparing comprises:
   determining differences in arrival times, at the computing device, among the acoustic reference signals.

9. The method of claim 1, further comprising:
   selectively deactivating one or more of the plurality of audio output devices based at least in part on the comparison.

10. The method of claim 1, wherein the dynamically reconfiguring comprises:
   detecting a movement of the computing device based on the changes in the acoustic reference signals received from the plurality of audio output devices; and
   reconfiguring the audio output characteristics of the at least one of the plurality of audio output devices based on the movement of the computing device.

11. The method of claim 1, wherein the acoustic reference signal represents at least a portion of audio content output by the plurality of audio output devices.

12. The method of claim 1, further comprising:
   triggering the plurality of audio output devices to output the acoustic reference signals at substantially the same time.

13. A computing device comprising:
   one or more processors;
   a memory storing instructions that, when executed by the one or more processors, cause the computing device to:
      receive an acoustic reference signal from each of a plurality of audio output devices;

compare the acoustic reference signal from each of the plurality of audio output devices with the acoustic reference signals from others of the plurality of audio output devices;

configure one or more audio output characteristics of the plurality of audio output devices based at least in part on the comparison of the acoustic reference signals; and dynamically reconfigure the audio output characteristics of at least one of the plurality of audio output devices in response to changes in the received acoustic reference signals.

14. The computing device of claim 13, wherein execution of the instructions to configure the one or more audio output characteristics causes the computing device to:

determine, from the comparison, a location of the computing device relative to each of the plurality of audio output devices; and configure the one or more audio output characteristics based at least in part on the location of the computing device.

15. The computing device of claim 14, wherein execution of the instructions to configure the one or more audio output characteristics causes the computing device to:

delay audio signals output by at least one of the plurality of audio output devices to enable corresponding audio signals output from each of the plurality of audio output devices to arrive at the location of the computing device at substantially the same time.

16. The computing device of claim 14, wherein execution of the instructions to configure the one or more audio output characteristics causes the computing device to:

adjust a volume of audio signals output by at least one of the plurality of audio output devices based on the location of the computing device relative to the at least one of the plurality of audio output devices.

17. The computing device of claim 13, wherein execution of the instructions to dynamically reconfigure the audio output characteristics causes the computing device to:

detect a movement of the computing device based on the changes in the acoustic reference signals received from the plurality of audio output devices; and reconfigure the audio output characteristics of the at least one of the plurality of audio output devices based on the movement of the computing device.

18. The computing device of claim 13, wherein execution of the instructions further causes the computing device to:

selectively deactivate one or more of the plurality of audio output devices based at least in part on the comparison.

19. The computing device of claim 13, wherein execution of the instructions further causes the computing device to:

trigger the plurality of audio output devices to output the acoustic reference signals at substantially the same time.

20. A non-transitory computer-readable medium storing instructions that, when executed by one or more processors of a computing device, cause the computing device to:

receive an acoustic reference signal from each of a plurality of audio output devices;

compare the acoustic reference signal from each of the plurality of audio output devices with the acoustic reference signals from others of the plurality of audio output devices;

configure one or more audio output characteristics of the plurality of audio output devices based at least in part on the comparison of the acoustic reference signals; and dynamically reconfigure the audio output characteristics of at least one of the plurality of audio output devices in response to changes in the received acoustic reference signals.

* * * * *